US009102138B2

(12) United States Patent
Suzuki et al.

(10) Patent No.: US 9,102,138 B2
(45) Date of Patent: Aug. 11, 2015

(54) IMAGE FORMING APPARATUS

(71) Applicants: Ryota Suzuki, Tokyo (JP); Takeo Tsukamoto, Kanagawa (JP); Hisayoshi Ohshima, Kanagawa (JP); Aino Hasegawa, Kanagawa (JP); Hideomi Sakuma, Kanagawa (JP); Manabu Seo, Kanagawa (JP); Hiroyuki Yamashita, Kanagawa (JP); Yuuma Usui, Kanagawa (JP); Takahiko Matsumoto, Kanagawa (JP); Takeshi Hihara, Kanagawa (JP)

(72) Inventors: Ryota Suzuki, Tokyo (JP); Takeo Tsukamoto, Kanagawa (JP); Hisayoshi Ohshima, Kanagawa (JP); Aino Hasegawa, Kanagawa (JP); Hideomi Sakuma, Kanagawa (JP); Manabu Seo, Kanagawa (JP); Hiroyuki Yamashita, Kanagawa (JP); Yuuma Usui, Kanagawa (JP); Takahiko Matsumoto, Kanagawa (JP); Takeshi Hihara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/349,007

(22) PCT Filed: Nov. 1, 2012

(86) PCT No.: PCT/JP2012/078905
§ 371 (c)(1),
(2) Date: Apr. 1, 2014

(87) PCT Pub. No.: WO2013/077187
PCT Pub. Date: May 30, 2013

(65) Prior Publication Data

US 2014/0240422 A1 Aug. 28, 2014

(30) Foreign Application Priority Data

Nov. 21, 2011 (JP) ..... 2011-254012
Jun. 20, 2012 (JP) ..... 2012-139125

(51) Int. Cl.
*B41J 2/005* (2006.01)
*B41J 2/175* (2006.01)

(52) U.S. Cl.
CPC ..... *B41J 2/0057* (2013.01); *B41J 2/17509* (2013.01); *B41J 2202/04* (2013.01)

(58) Field of Classification Search
CPC ..... B41J 2/0057; Y10S 101/37
USPC ..... 347/103, 101, 112, 21
See application file for complete search history.

(56) References Cited

U.S. PATENT DOCUMENTS 3,872,480 A * 3/1975 Engelbrecht ..... 347/149
4,317,124 A * 2/1982 Shirato et al. ..... 347/67

(Continued)

FOREIGN PATENT DOCUMENTS

JP 2010-173201 8/2010
JP 2010-188665 9/2010
JP 2010-208147 9/2010
JP 2010-247381 11/2010

(Continued)

OTHER PUBLICATIONS

International Search Report Issued Feb. 12, 2013 in PCT/JP2012/078905 Filed on Nov. 1, 2012.

*Primary Examiner* — Stephen Meier
*Assistant Examiner* — John P Zimmermann
(74) *Attorney, Agent, or Firm* — Oblon, McClelland, Maier & Neustadt, L.L.P.

(57) ABSTRACT

Using an intermediate transfer body onto which a conductive recording liquid containing water that is ejected by heads is provided; and a potential applying unit which applies a potential which can electrolyze the water within the conductive recording liquid which is ejected from the heads and which temporarily bridges between the heads and the intermediate transfer body, the potential applying unit applies a potential between the intermediate transfer body and electrodes which are in contact with the recording liquid in supplying units which supply the recording liquid to the heads.

11 Claims, 8 Drawing Sheets

(56) References Cited

U.S. PATENT DOCUMENTS

| | | | | |
|---|---|---|---|---|
| 5,841,456 | A * | 11/1998 | Takei et al. | 347/103 |
| 5,925,230 | A * | 7/1999 | Fajt et al. | 204/666 |
| 6,386,683 | B1 * | 5/2002 | Muroi et al. | 347/55 |
| 7,677,716 | B2 * | 3/2010 | Vega et al. | 347/103 |
| 8,382,233 | B2 | 2/2013 | Usui et al. | |
| 2011/0108437 | A1 * | 5/2011 | Tanahashi et al. | 205/742 |
| 2011/0273523 | A1 | 11/2011 | Tsukamoto et al. | |
| 2013/0057628 | A1 | 3/2013 | Suzuki et al. | |

FOREIGN PATENT DOCUMENTS

| | | |
|---|---|---|
| JP | 2010-247428 | 11/2010 |
| JP | 2010-253807 | 11/2010 |
| JP | 2010-264717 | 11/2010 |
| JP | 2011-062890 | 3/2011 |
| JP | 2011-084041 | 4/2011 |
| JP | 2011-167885 | 9/2011 |
| JP | 2011-230393 | 11/2011 |
| JP | 2011-235589 | 11/2011 |
| JP | 2012-052027 | 3/2012 |

* cited by examiner

IMAGE FORMING APPARATUS

TECHNICAL FIELD

The present invention relates to an inkjet image forming apparatus which applies a recording liquid such as ink to an intermediate transfer body with a head to perform image forming.

BACKGROUND ART

Related art inkjet image forming apparatuses such as inkjet printers, etc., are known that include a head which turns a recording liquid such as ink, etc., from multiple micro nozzles into liquid droplets to eject the droplets to perform inkjet recording by a movable actuator scheme represented by a piezoelectric scheme or a heating film boiling scheme represented by a thermal scheme, etc. (see Patent Documents 1 to 3, for example).

In an inkjet scheme, with the feature that the recording liquid is directly ejected from the head onto recording material such as recording paper, etc., the head and the recording material approach each other, so that paper dust, dust, etc., that are adhered to the recording material are likely to adhere to a nozzle. If the paper dust, etc., adhere to the nozzle, a flying direction of liquid droplets which are ejected from the nozzle is disturbed, or the nozzle is clogged, so that image quality and reliability decrease. As a measure for avoiding such a problem, it is common to give priority to stability of ejecting from the nozzle and use the recording liquid with a low viscosity. However, with the recording liquid with the low viscosity, a blur is likely to occur when it impacts onto the recording material.

Thus, image forming apparatuses are being proposed that include an intermediate transfer body which carries the recording liquid ejected from the head, wherein an image is formed onto the intermediate transfer body, after which the formed image is transferred onto the recording material (see Patent Documents 1 to 3).

More specifically, a technique is being proposed that uses a head which ejects conductive ink including water; an intermediate transfer body having a conductive surface onto which the ink which is ejected by the head is provided; a potential applying unit which applies a potential which can electrolyze water within a liquid column of ink which temporarily bridges between the head and the intermediate transfer body; and a transfer unit which transfers an ink image carried on the intermediate transfer body onto the recording material, wherein the potential is applied by the potential applying unit between an electrode within the head and a surface of the intermediate transfer body, and a pH change caused by electrolysis of the water within the liquid column of ink is used to increase viscosity of the ink to seek increasing preventability of an ink blur and stability of ejecting the ink from the nozzle (see Patent Documents 1 to 3, for example).

However, it has been recognized by a validation of the inventors that a problem may arise that, if such a technique is used, the pH of the ink within the head ends up changing towards a direction of preventing an increase in the viscosity as the electrode for electrolyzing the water within the ink is provided within the head, so that ejecting of the ink with the pH changed in such a manner causes the increase in the viscosity of the ink on the intermediate transfer body to be inhibited.

With respect to the above-described problem, it is implied that if the electrode is a nozzle plate which is provided in the head and with which the ink is in contact, when a contact area of the nozzle plate to the ink is compared with an area of a liquid column which is in contact with an intermediate transfer body surface, in case the former area is sufficiently larger than the latter area, electrolysis at an interface between the nozzle plate and the ink does not occur, so that the increase in the viscosity of the ink is inhibited. Moreover, if such an implication is correct, a technique which increases the above-described contact area (see Patent documents 2 and 3, for example) leads to a decreased likelihood of such a problem occurring.

However, according to a more detailed validation by the inventors, it has been recognized that when the former area is larger than the latter area, electrolytic reactions no longer occur in both poles when the former electric double layer is not sufficiently formed even though the latter electric double layer is sufficiently formed.

Then, a basic function of increasing the viscosity of the ink using a pH change caused by the electrolysis of the water in the liquid column form is lost, so that even in seeking to improve the ink blur preventability, the stability in ejecting the ink from the nozzle may become difficult. In other words, it is considered that while the above-described technique which increases the contact area is effective to some extent in suppressing reactions in which the ink on the nozzle plate side is prevented from increasing in viscosity, at the same time, it causes reactions in which pH changes in a direction in which the viscosity of the ink is increased on the intermediate transfer body side to be lost.

Thus, the above-described technique which increases the contact area does not become a fundamental solution to a problem of inhibiting the increase in the viscosity of the ink on the intermediate transfer body.

Taking the above into account, it is necessary to avoid the electrolysis at the interface between the nozzle plate and the ink while maintaining electrolytic reactions in both poles and to suppress the pH change towards a direction of preventing the increase in the viscosity of the ink within the head.

Moreover, when the electrolysis occurs at the interface between the nozzle plate and the ink, a problem may arise that the increase in the viscosity of the ink on the intermediate transfer body is inhibited as well as that air bubbles are produced within the head, so that ejecting performance of the ink decreases.

An object of the present invention is to provide an image forming apparatus which provides a recording liquid such as ink, etc., to an intermediate transfer body with a head to perform image forming, wherein the image forming apparatus makes it possible to suppress a change in pH of the recording liquid within the head while utilizing electrolysis of water within the recording liquid to suppress a blur without providing a treatment liquid or a powder other than the recording liquid and which prevents generating of air bubbles within the head by the above-described electrolysis to maintain performance of ejecting the recording liquid from the head.

SUMMARY OF THE INVENTION

Means for Solving the Problems

In order to achieve the above-described object, an image forming apparatus is provided according to the present invention, the image forming apparatus including a head which is provided with a nozzle which ejects a conductive recording liquid containing water; an intermediate transfer body to which the conductive recording liquid ejected by the head is provided, at least a surface of which intermediate transfer body is conductive; a potential applying unit for applying a potential which can electrolyze the water within the conductive recording liquid which is, ejected from the head and which temporarily bridges between the head and the intermediate transfer body; a transfer unit which transfers, to a recording material, an image carried on the intermediate transfer body with the conductive recording liquid; and a recording liquid supplying unit which supplies the conductive recording liquid to the head, wherein the potential applying unit includes an electrode provided at a portion which is in contact with the recording liquid in the recording liquid supplying unit and applies the potential between the surface of the intermediate transfer body and the electrode.

According to the present invention, an image forming apparatus is provided, the image forming apparatus including a head which is provided with a nozzle which ejects a conductive recording liquid containing water; an intermediate transfer body to which the conductive recording liquid ejected by the head is provided, at least a surface of which intermediate transfer body is conductive; a potential applying unit for applying a potential which can electrolyze the water within the conductive recording liquid which is ejected from the head and which temporarily bridges between the head and the intermediate transfer body; a transfer unit which transfers, to a recording material, an image carried on the intermediate transfer body with the conductive recording liquid; and a recording liquid supplying unit which supplies the conductive recording liquid to the head, wherein the potential applying unit includes an electrode provided at a portion which is in contact with the recording liquid in the recording liquid supplying unit and applies the potential between the surface of the intermediate transfer body and the electrode. The present invention makes it possible to provide an image forming apparatus which suppresses a change in pH of the recording liquid within the head while utilizing electrolysis of the water within the recording liquid to suppress a blur without providing a treatment liquid or a powder other than the recording liquid and which prevents generating of air bubbles within the head by the above-described electrolysis to maintain performance of ejecting the recording liquid from the head.

MODE FOR CARRYING OUT THE INVENTION

Figure 1:
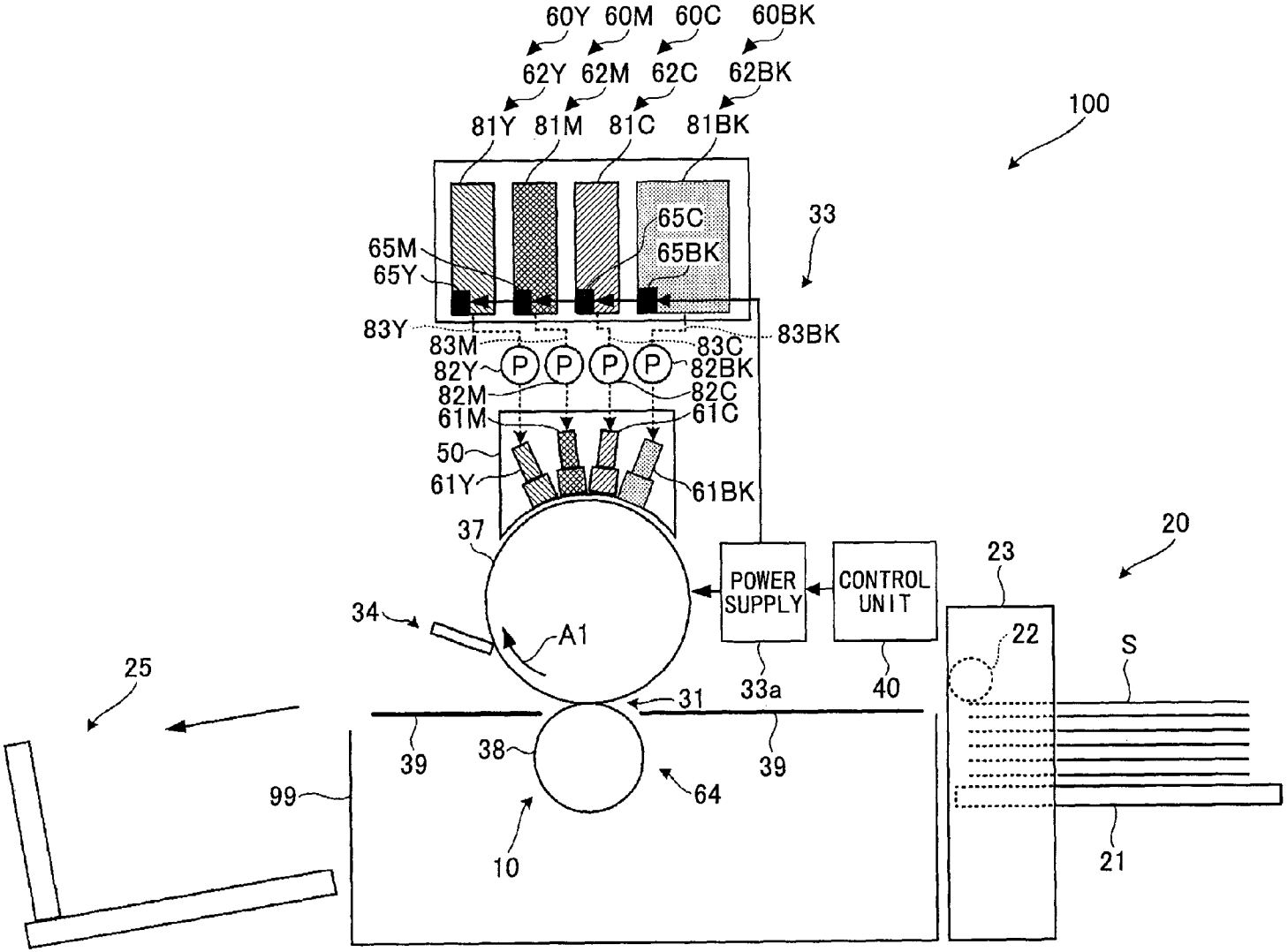
FIG. 1 is a schematic front view of an exemplary image forming apparatus to which the present invention is applied.

FIG. 1 shows a schematic of an exemplary image forming apparatus to which the present invention is applied. The image forming apparatus 100 is a printer such as an inkjet printer that can perform full-color image forming. The image forming apparatus 100 performs an image forming process based on an image signal which corresponds to image information received from outside.

The image forming apparatus 100 can perform image forming on plain paper, which is generally used for copying, etc.; an OHP sheet; thick paper such as a postcard, a card, etc.; and an envelope, etc., as sheet-shaped recording media. While the image forming apparatus 100 is a single side image forming apparatus which can perform image forming on a single side of a transfer sheet S, which as a sheet is a recording body, which is recording material, which is a recording medium, it may be a double side image forming apparatus which can perform image forming on both sides of the transfer sheet S.

The image forming apparatus 100 has heads 61Y, 61M, 61C, and 61BK as recording heads, each of which is an ink head as a recording liquid ejecting body which ejects a recording liquid, which is a conductive recording liquid such as ink of relevant colors. The heads can form images, and correspond to respective separated colors of yellow, magenta, cyan, and black.

The heads 61Y, 61M, 61C, and 61BK are arranged at positions which oppose an outer peripheral face of an intermediate transfer body 37, which is an intermediate transfer drum arranged at a generally central portion of a body 99 of the image forming apparatus 100. The heads 61Y, 61M, 61C, and 61BK are aligned in the very same order from the upstream side of an A1 direction, which is a moving direction of the intermediate transfer body 37 and which is a clockwise direction in FIG. 1. Y, M, C, and BK, which are given after numbers of members therein, indicate that they are members for yellow, magenta, cyan, and black respectively.

The heads 61Y, 61M, 61C, and 61BK are respectively provided in ink ejecting apparatuses 60Y, 60M, 60C, and 60BK, which are recording liquid ejecting apparatuses for forming images of yellow (Y), magenta (M), cyan (C), and black (BK). The respective heads 61Y, 61M, 61C, and 61BK are provided in the ink ejecting apparatuses 60Y, 60M, 60C, and 60BK such that multiple ones thereof are installed together in a direction orthogonal to a paper face in FIG. 1.

Onto the intermediate transfer body 37, the recording liquids of yellow, magenta, cyan, and black are ejected and provided from the respective heads 61Y, 61M, 61C, and 61BK such that they successively overlap at regions which oppose the respective heads 61Y, 61M, 61C, and 61BK while the intermediate transfer body 37 rotates in the A1 direction, so that an image is formed on a surface thereof. In this way, the image forming apparatus 100 is arranged as a tandem structure which causes the heads 61Y, 61M, 61C, and 61BK to oppose the intermediate transfer body 37 and to be installed together in the A1 direction.

Ejecting, or, in other words, providing of the recording liquid onto the intermediate transfer body 37 by the heads 61Y, 61M, 61C, and 61BK is performed with staggered timings from the upstream side to the downstream side in the A1 direction such that image regions of each color of yellow, magenta, cyan, and black overlap at the same position on the intermediate transfer body 37.

The image forming apparatus 100 includes the ink ejecting apparatuses 60Y, 60M, 60C, and 60BK, which include the heads 61Y, 61M, 61C, and 61BK, respectively; a conveying unit 10 as a sheet conveying unit which includes the intermediate transfer body 37 and which conveys the transfer sheet S with rotating of the intermediate transfer body 37 in the A1 direction; a sheet-feeding unit 20 which can have stacked a large number of transfer sheets S and which feeds, towards the conveying unit 10, only a top transfer sheet S of the transfer sheets S stacked; and a sheet-discharging platform 25 which can hold a large number of transfer sheets S on which image forming is performed, or, in other words, which are already printed that are conveyed by the conveying unit 10.

Moreover, the image forming apparatus 100 includes an energizing unit 33 as a potential applying unit, which is a voltage applying unit which performs energizing including a current component caused by electrode oxidation reactions or electrode reduction reactions inside a recording liquid in a liquid-column state. The liquid column formed by the recording liquid immediately after being ejected from the heads 61Y, 61M, 61C, and 61BK as shown in FIG. 2B temporarily bridges between the heads 61Y, 61M, 61C, and 61BK and the intermediate transfer body 37, which facilitates the increase in the viscosity of the recording liquid in such a state.

Moreover, as shown in FIG. 1, the image forming apparatus 100 includes a cleaning unit 34 as a cleaning unit for removing a recording liquid, etc., which remains on the intermediate transfer body 37 from the intermediate transfer body 37 after the recording liquid, etc., are transferred to the transfer sheet S; a carriage 50 as a head supporting body which integrally supports the heads 61Y, 61M, 61C, and 61BK; and a control unit 40 as a control unit including a CPU, a memory, etc., that controls the overall operation of the image forming apparatus 100.

Besides the intermediate transfer body 37, the conveying unit 10 includes a transfer unit 64 which transfers, to the transfer sheet S, an image formed by the recording liquid carried on the intermediate transfer body 37 when the transfer sheet S passes through the transfer unit 31, which is a region arranged to oppose the intermediate transfer body 37 and which is between the transfer unit 64 and the intermediate transfer body 37; a guide plate 39 which guides, to the sheet-discharging platform 25, the transfer sheet S which passed through the transfer unit 31; and a motor, etc., as a driving unit (not shown) which rotationally drives the intermediate transfer body 37 in the A1 direction. In this way, the image forming apparatus 100 is arranged to be an indirect image forming apparatus which indirectly performs image forming onto the transfer sheet S using the intermediate transfer body 37.

The transfer unit 64 includes a transfer roller 38 which rotates in a manner such that it is coupled to the intermediate transfer body 37. The transfer roller 38 may have embedded therein a heater for fixing, onto the transfer sheet S, an image which is transferred to the transfer sheet S. Moreover, the conveying unit 10 may include a fixing roller as a fixing unit for fixing, onto the transfer sheet S, an image which is transferred from the intermediate transfer body 37 to the transfer sheet S by the transfer roller 38.

Figure 2A:
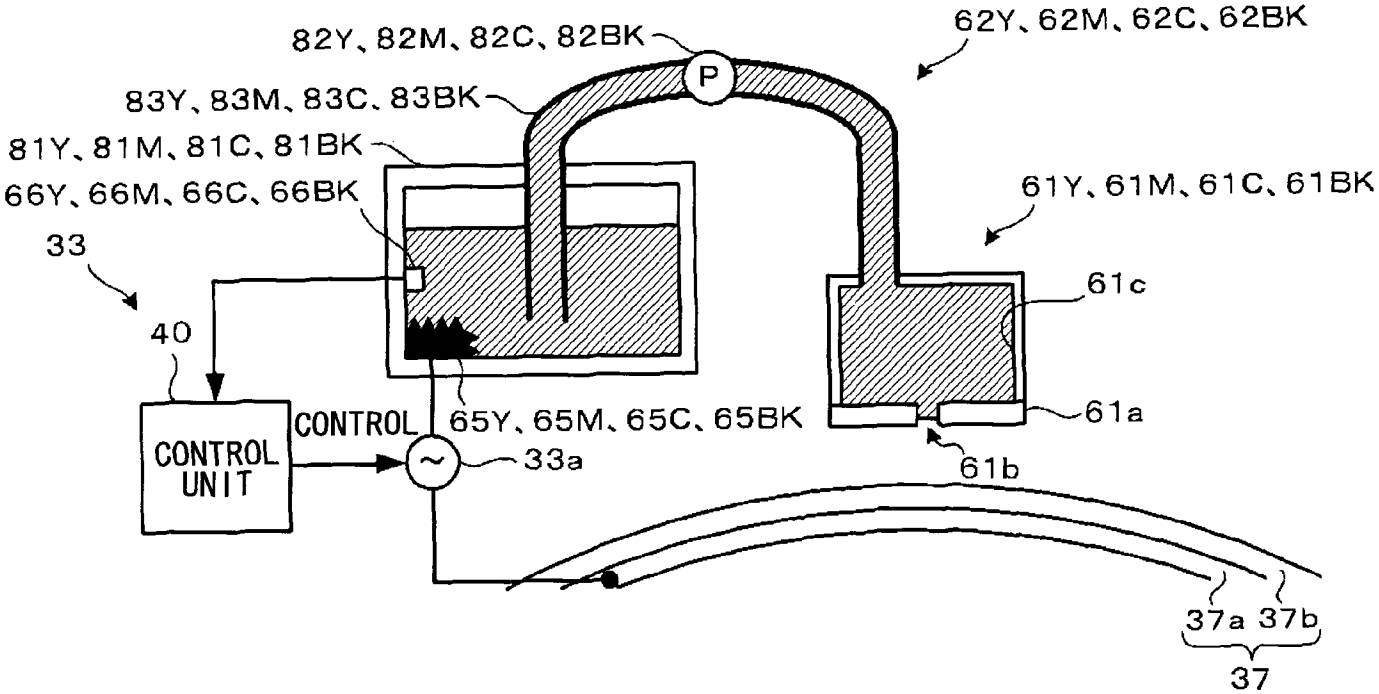
FIGS. 2A to 2C are schematic views showing a recording liquid supplying unit which is mounted in the image forming apparatus shown in FIG. 1 and how a conductive recording liquid is provided to an intermediate transfer body from a head in the image forming apparatus.
Figure 2B:
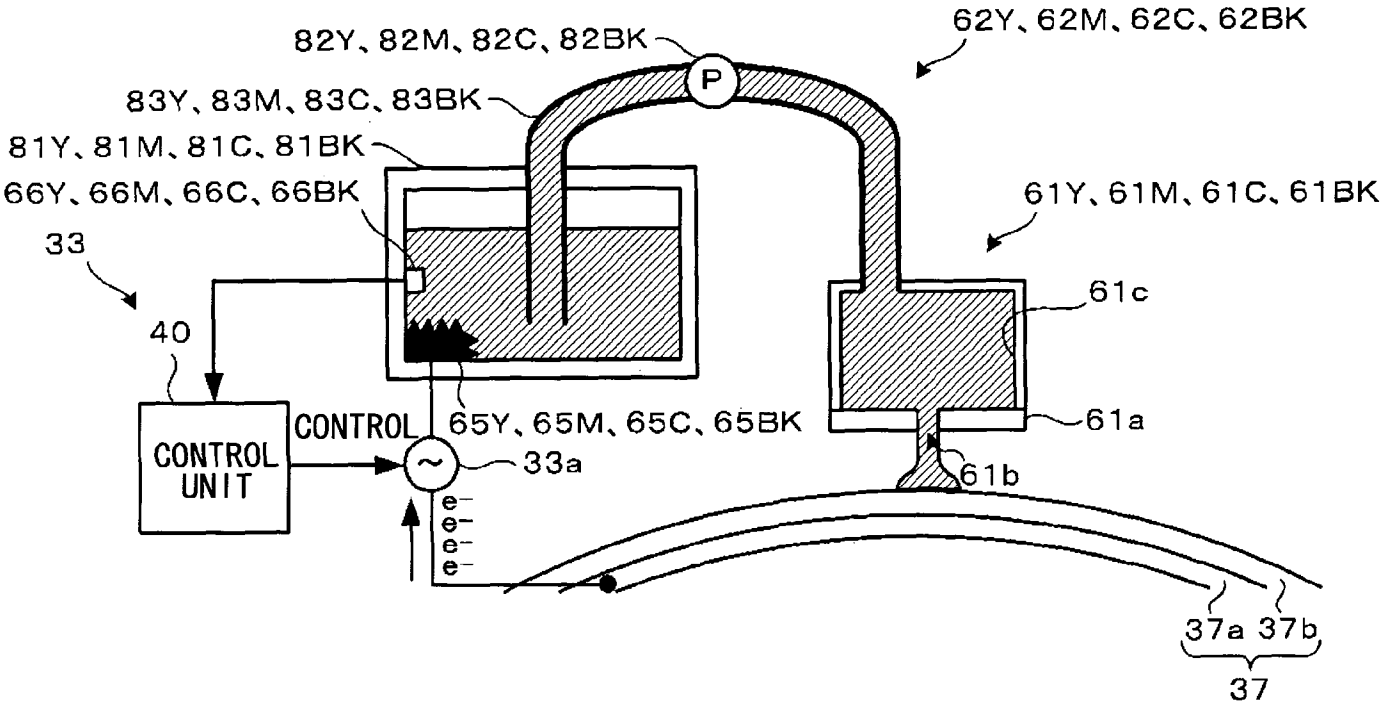
Figure 2C:
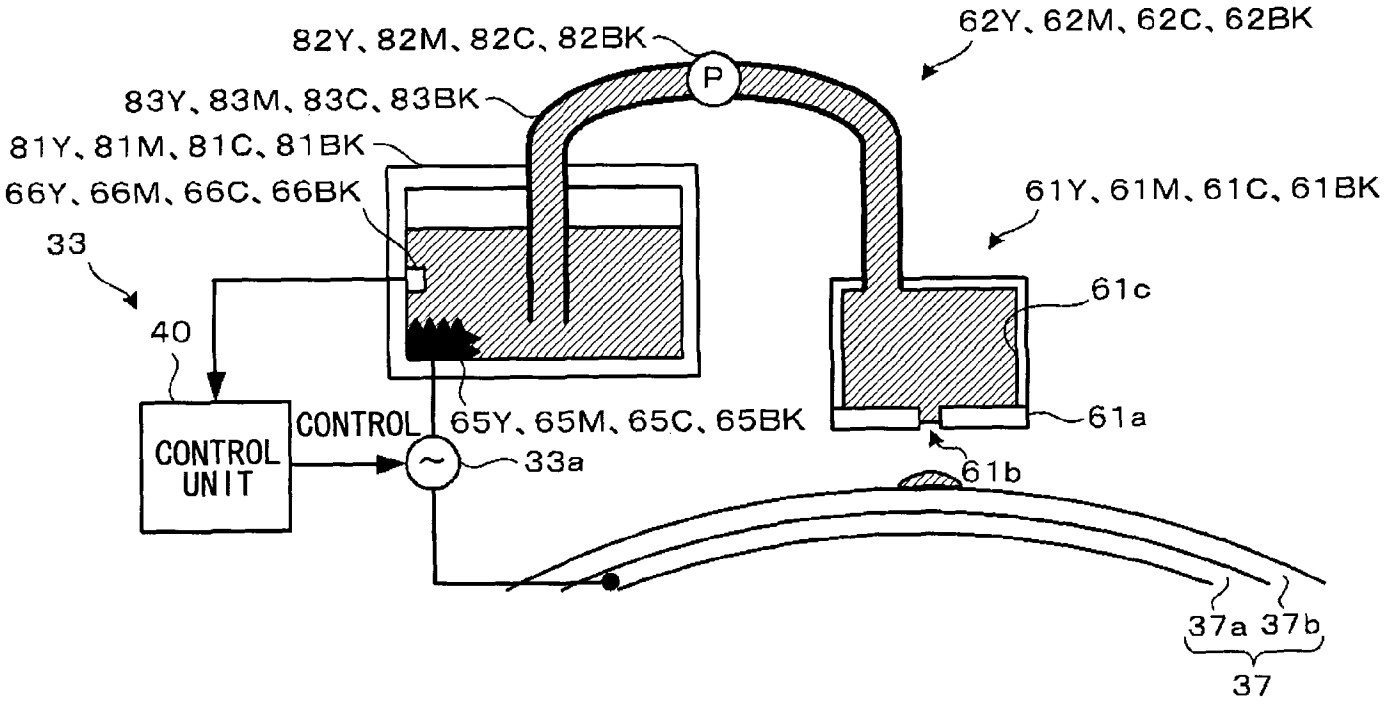

As shown in FIGS. 2A to 2C, the intermediate transfer body 37 includes a support 37*a* made of aluminum that is a conductive substrate; and a surface layer 37*b* made of silicone rubber that is formed on the support 37*a*. A material for the support 37*a* is not limited to aluminum, so that the support 37*a* may be formed with metals such as an aluminum alloy, copper, stainless steel, etc., for example, as long as it has mechanical strength. A material for the surface layer 37*b* is not limited to silicone rubber, so that it may be an elastic material with low surface energy and high followability with respect to the transfer sheet S for the benefit of high release properties of the recording liquid, and may be formed with urethane rubber, fluororubber, nitrile butadiene rubber, etc.

In order to provide conductivity to the intermediate transfer body 37, the surface layer 37*b* is arranged to be a conductive layer with a conductive rubber in which microparticles of metals such as carbon, platinum, gold, etc., as a conductant agent are dispersed and mixed into the forementioned rubber material. There is a tradeoff relationship in which increasing the conductive microparticles increases conductivity, while decreasing mold releasability, so that an adjustment is necessary as needed. As described below, in order to form a desired potential difference in the recording liquid while the heads 61Y, 61M, 61C, and 61BK and the intermediate transfer body 37 are temporarily bridged together, a volume resistivity of the conductive rubber is preferably less than $10^3$ Ω·cm. Moreover, it is desirably less than the volume resistivity of the recording liquid.

A thickness of the surface layer 37*b* is preferably 0.1-1 mm and is more preferably 0.2-0.6 mm. The surface layer 37*b* is not a mandatory feature, so that it may be arranged for only the support 37*a* to be the surface of the intermediate transfer body 37. Moreover, as long as the surface thereof is conductive, the intermediate transfer body 37 may be endless belt-shaped and not drum shaped and may also be sheet shaped, if possible.

As shown in FIG. 1, the sheet-supplying unit 20 includes a sheet-supplying tray 21, which can have stacked a large number of transfer sheets S; a sheet-supplying roller 22, which supplies, towards the conveying unit 10, only a topmost transfer sheet S of the transfer sheets S stacked in the sheet-supplying tray 21; a housing 23 which supports the sheet-supplying tray 21 and the sheet-supplying roller 22; and a motor, etc., as a driving unit (not shown) that rotationally drives such that it aligns with ejecting timing of the recording liquid in the heads 61Y, 61M, 61C, and 61BK and which supplies the transfer sheet S.

The carriage 50 is arranged integrally with the heads 61Y, 61M, 61C, and 61BK and detachably relative to a main body 99 such that the heads 61Y, 61M, 61C, and 61BK can be replaced with new ones when degradation, etc., occurs with the heads 61Y, 61M, 61C, and 61BK and also in order to facilitate maintenance. The heads 61Y, 61M, 61C, 61BK are also respectively arranged to be independently detachable relative to the main body 99 such that they can be replaced with new ones when degradation, etc., occurs and also in order to facilitate maintenance. In this way, replacement and maintenance tasks are facilitated.

For the ink ejecting apparatuses 60Y, 60M, 60C, and 60BK, while colors of a recording liquid used differ, otherwise they have generally the same configurations. The ink ejecting apparatuses 60Y, 60M, 60C, and 60BK have respectively a multiple number of heads 61Y, 61M, 61C, and 61BK installed together in a main scanning direction and the ink ejecting apparatuses 60Y, 60M, 60C, 60BK, and the image forming apparatus 100 are arranged to be of a head fixed full-line type.

The ink ejecting apparatuses 60Y, 60M, 60C, and 60BK include multiple heads 61Y, 61M, 61C, 61BK; and recording liquid supplying units 62Y, 62M, 62C, and 62BK, which supply a recording liquid of a relevant color to each of the heads 61Y, 61M, 61C, and 61BK.

The recording liquid supplying units 62Y, 62M, 62C, and 62BK respectively include tanks 81Y, 81M, 81C, and 81BK, which are ink tanks as main tanks for carrying recording liquids of relevant colors for supplying the heads 61Y, 61M, 61C, and 61BK; and pumps 82Y, 82M, 82C, and 82BK as supplying pumps for force feeding and supplying ink towards the respective heads 61Y, 61M, 61C, and 61BK.

Moreover, as shown in FIGS. 2A to 2C, the recording liquid supplying units 62Y, 62M, 62C, and 62BK respectively include pH measuring units 66Y, 66M, 66C, and 66BK which measure pH of the recording liquid within the tanks 81Y, 81M, 81C, and 81BK and input the measured pH values into the control unit 40; and a distributor tank (not shown), which is a distributor as an ink supplying unit as a recording liquid supplying unit which distributes and supplies the recording liquid supplied from the tanks 81Y, 81M, 81C, and 81BK side by the pumps 82Y, 82M, 82C, and 82BK to the respective heads 61Y, 61M, 61C, and 61BK.

Moreover, the recording liquid supplying units 62Y, 62M, 62C, and 62BK respectively include ink amount detecting sensors (not shown) as an ink amount detecting unit as a recording liquid amount detecting unit which detects the recording liquid amount in order to detect a shortage of a recording liquid amount within a distributor tank; and pipes 83Y, 83M, 83C, and 83BK, which form, together with the pumps 82Y, 82M, 82C, and 82BK, a supplying path of the recording liquid between the tanks 81Y, 81M, 81C, and 81BK and the distributor tank and also forms a supplying path of the recording liquid between the distributor tank and the respective heads 61Y, 61M, 61C, and 61BK. The respective recording liquid supplying units 62Y, 62M, 62C, and 62B may include the respective tanks 81Y, 81M, 81C, and 81BK integrally with the heads 61Y, 61M, 61C, and 61BK.

The tanks 81Y, 81M, 81C, and 81BK are arranged detachably relative to the main body 99 such that they can be replaced with new ones when the recording liquid inside is consumed and little or no amount remains, etc., and also in order to facilitate maintenance. The tanks 81Y, 81M, 81C, and 81BK are made of ink cartridges, which are recording liquid cartridges; however, they are not limited thereto, so that they may be of a fixed type. At a portion which is in contact with the recording liquid that is within the tanks 81Y, 81M, 81C, and 81BK, or, more specifically, at an inner wall are provided electrodes 65Y, 65M, 65C, and 65BK, which make up a part of the energizing unit 33.

The pumps 82Y, 82M, 82C, and 82BK have operations thereof controlled by the control unit 40. More specifically, with a condition that a shortage is detected of the recording liquid amount within the distributor tank by the ink amount detecting sensor, they are driven until the shortage ceases to be detected and supply the recording liquid within the tanks 81Y, 81M, 81C, and 81BK to the distributor tank. The control unit 40 functions as an ink supplying control unit, which is a recording liquid supplying control unit. For the features which are driven by the image forming apparatus 100, the control unit 40 is arranged to control the driving thereof even when they are not specifically described.

The recording liquid contains at least coloring agents corresponding to yellow, magenta, cyan, and black; an anionic dispersant, which is a dispersant for the coloring agents; and a solvent. With such coloring agents and such a dispersant, an ink ingredient of the recording liquid has an anionic group. The solvent contains water from a safety point of view and a point of view of conductivity for causing electrolysis as described below; and the recording liquid is arranged to be a water soluble recording liquid, which is a conductive ink and a water soluble ink. The recording liquid is desirably alkaline from a point of view of storage stability.

Pigments, which are coloring agents for use in the recording liquid, include, while they are not limited thereto, as pigments for orange or yellow, C.I. pigment orange 31, C.I. pigment orange 43; C.I. pigment yellow 12; C.I. pigment yellow 13; C.I. pigment yellow 14; C.I. pigment yellow 15; C.I pigment yellow 17; C.I. pigment yellow 74; C.I. pigment yellow 93; C.I. pigment yellow 94; C.I. pigment yellow 128; C.I. pigment yellow 138; C.I. pigment yellow 151; C.I. pigment yellow 155; C.I. pigment yellow 180; C.I. pigment yellow 185, etc.

Moreover, pigments for red or magenta includes C.I. pigment red 2; C.I. pigment red 3; C.I. pigment red 5; C.I. pigment red 6; C.I. pigment red 7; C.I. pigment red 15; C.I. pigment red 16; C.I. pigment red 48; C.I. pigment red 53; C.I. pigment red 57; C.I. pigment red 122; C.I. pigment red 123; C.I. pigment red 139; C.I. pigment red 144; C.I. pigment red 149; C.I. pigment red 166; C.I. pigment red 177; C.I. pigment red 178; C.I. pigment red 222, etc.

Furthermore, pigments for green or cyan include C.I. pigment blue 15; C.I. pigment blue 15:2; C.I. pigment blue 15:3; C.I. pigment blue 16; C.I. pigment blue 60; C.I. pigment green 7, etc.

Moreover, pigments for black include C.I. pigment black 1; C.I. pigment black 6; C.I. pigment black 7, etc.

The content of pigments within the recording liquid is normally 0.1-40 wt. %, is preferably 1-30 wt. %; and more preferably 2-20 wt. %.

As the anionic dispersant, it is preferable to contain a high-molecular type dispersant, or a low-molecular type dispersant such as a surfactant.

Examples of the high-molecular type dispersant which has the anionic group include polyacrylic acid and the salt thereof; polymethacrylic acid and the salt thereof; acrylic acid-acrylonitrile copolymer and the salt thereof; acrylic acid-alkyl acrylate ester copolymer and the salt thereof; styrene-acrylic acid copolymer and the salt thereof; styrene-methacrylic acid copolymer and the salt thereof; styrene-acrylic acid-alkyl acrylate ester copolymer and the salt thereof; styrene-methacrylic acid-alkyl acrylate ester copolymer and the salt thereof; styrene-α methyl styrene-acrylic acid copolymer and the salt thereof; styrene-α methyl styrene-acrylic acid copolymer-alkyl acrylate ester copolymer and the salt thereof; styrene-maleic acid copolymer and the salt thereof; vinylnaphthalene-maleic acid copolymer and the salt thereof; vinyl acetate-ethylene copolymer and the salt thereof; vinyl acetate-crotonic acid copolymer and the salt thereof; vinyl acetate-acrylic acid copolymer and the salt thereof; β naphthalenesulfonic acid, polymer with formaldehyde, etc.

These high molecular anionic dispersants are preferable in cohesiveness relative to a self-dispersing pigment simple substance since they react with hydrogen ions which are generated with the electrolysis of the water to cohere. Moreover, these high molecular anionic dispersants have an advantage of improving a rate of transfer to the transfer sheet S from the intermediate transfer body 37 in the transfer process since they have a function of adhering the coloring agent.

The low-molecular type dispersant which has the anionic group includes, in particular, a dispersant using oleic acid and the salt thereof; lauric acid and the salt thereof; behenic acid and the salt thereof; stearic acid and the salt thereof; fatty acid and the salt thereof; dodecyl sulfonic acid and the salt thereof; decyl sulfonic acid and the salt thereof; alkyl sulfonic acid and the salt thereof; alkyl ether sulfates such as oleyl sulfate, lauryl sulfate, etc.; dodecyl benzene sulfonic acid and the salt thereof; lauryl benzene sulfonic acid and the salt thereof; alkyl dodecyl benzene sulfonic acid and the salt thereof; dioctyl sulfo succinic acid and the salt thereof; dihexyl sulfo succinic acid and the salt thereof; dialkyl sulfo succinic acid and the salt thereof; naphthyl sulfonic acid and the salt thereof; naphthyl carboxylic acid and the salt thereof; aromatic anionic surfactant; and fluoroanionic surfactants such as polyoxyethylene alkyl ether acetate, polyoxyethylene alkyl ether phosphate, polyoxyethylene alkyl ether sulfonate, fluoroalkyl carboxylic acid and the salt thereof, fluoroalkyl sulfonic acid and the salt thereof, etc.

The recording liquid, which uses water as a main liquid medium, preferably uses the below-described aqueous organic solvent as a moisturizing agent ingredient in order to make the recording liquid have desired properties or in order to prevent the nozzle 61*c* from clogging due to drying of the recording liquid.

Specific aqueous organic solvents include polyalcohols such as ethylene glycol, diethylene glycol, triethylene glycol, tetraethylene glycol, propylene glycol, 1,3-propanediol, 2-methyl-1,3-propanediol, 1,4-butanediol, 1,5-pentanediol, 1,6-hexanediol, glycerin, 1,2,6-hexanetriol, 2-ethyl-1,3-hexanediol, 1,2,4-butanetriol, 1,2,3-butanetriol, 3-methyl-1,3,5-pentanetriol; polyalcohol alkyl ethers such as ethylene glycol monoethyl ether, ethylene glycol monobutyl ether, diethylene glycol monomethyl ether, diethylene glycol monoethyl ether, diethylene glycol monobutyl ether, triethylene glycol monobutyl ether, tetraethylene glycol monomethyl ether, propylene glycol monoethyl ether, etc.; polyalcohol aryl ethers such as ethylene glycol monophenyl ether, ethylene glycol monobenzyl ether, etc.; nitrogen-containing heterocyclic compounds such as N-methyl-2-pyrrolidone, N-hydroxyethyl-2-pyrrolidone, 2-pyrrolidone, 1,3-dimethylimidazolidinone, ϵ-caprolactam, etc.; amides such as formamide, N-methylformamide, N,N-dimethylformamide, etc.; amines such as monoethanolamine, diethanolamine, triethanolamine, monoethylamine, diethylamine, triethylamine, etc.; sulfur-containing compounds such as dimethylsulfoxide, sulfolane, thiodiethanol, etc.; propylene carbonate, ethylene carbonate, γ-butyrolactone, etc., of which two or more types may be used together.

Moreover, as other moisturizing ingredients, sugar alcohol such as sorbitol, etc.; polysaccharides such as hyaluronic acid, etc.; polymer such as polyethylene glycol, etc.; as well as natural moisturizing ingredients such as urea, lactic acid, citrate, and amino acids may be used. One of these solvents is used solely with water or multiple of these solvents are mixed and used with water. While there is no particular limit to the content of these aqueous organic solvents, they are preferably used in a range of 1-60 wt. % and more preferably used in a range of 10-40 wt. % of the whole ink.

The recording liquid includes an ABA-type amphiphilic polymer including a hydrophobic A segment and a hydrophilic B segment; and a carboxylic acid-based surfactant which causes the ABA-type amphiphilic polymer to be dissolved or dispersed in the aqueous solvent.

Any of the following ones can be applied for the hydrophobic A segment or a hydrophobic A block of the ABA-type amphiphilic polymer. For example, they include straight-chain alkyl groups with alkyl C of at least 12, such as dodecyl, tridecyl, tetradecyl, pentadecyl, hexadecyl, heptadecyl, octadecyl, nonadecyl, eicosyl, etc. Moreover, they include branch alkyl groups such as combinations of 2-decyl dodecyl, 2-dodecyl dodecyl, 2-decyl hexadecyl, etc. Furthermore, they include aromatic containing alkyl groups such as phenylalkyl, diphenyl alkyl, triphenyl alkyl, naphthyl alkyl, dinaphthyl alkyl, trinaphthyl alkyl, anthracenyl alkyl, trialkyl phenyl alkyl, and dialkyl phenyl alkyl including a phenyl group which is a branch alkyl group with a benzyne ring as a branch point. Moreover, they include those containing a ring-shaped alkyl group, such as cyclohexyl alkyl, dialkyl cyclohexyl alkyl, trialkyl cyclohexyl alkyl, cyclopentyl alkyl, dialkyl cyclopentyl alkyl, trialkyl cyclopentyl alkyl, etc. In this way, the hydrophobic A block desirably contains at least one of the straight-chain alkyl group, a branch alkyl group, a ring-shaped alkyl group; and a phenyl group.

Moreover, it may be a block polymer by a hydrophobic monomer. For example, it may include a styrene polymer, an alkyl acrylate polymer, an alkyl methacrylate polymer, an acrylic amide alkyl polymer, a methacrylamide alkyl polymer, etc.

For the hydrophilic B segment or the hydrophilic B block of the ABA-type amphiphilic polymer, any one of them can be applied as long as it has affinity to the aqueous solvent. In order to increase viscosity of an ink composition with a physical bridge due to hydrophobic association within the aqueous solvent, it is necessary for the chain length for the hydrophilic B block to be sufficiently long relative to that for the hydrophobic A block; such a hydrophilic B block includes at least 100-mer units of a propylene oxide polymer or an ethylene oxide polymer including a straight-chain polyethylene oxide. The hydrophilic B block may be a 6-Arms structure or a 4-Arms structure that includes multi-branched polyethelene oxide, in which a hydrophilic portion is branched. The term Arms represents the hydrophobic A block. In this way, the hydrophilic block B desirably includes at least one of the straight-chain polyethylene oxide and a multi-branched polyethylene oxide.

Moreover, in this way, the ABA type amphiphilic polymer is desirably an $A_nB$ type amphiphilic polymer, which includes at least three hydrophobic A blocks. This is because it becomes likely for hydrophobic association between hydrophobic A segments to occur and viscosity responsiveness to a pH change increases. The "ABA-type" in the ABA-type amphiphilic polymer means that it is a structure in which a hydrophilic B block and multiple hydrophobic A blocks are bonded with the hydrophilic B block at the center.

In addition, hydrophilic B blocks include a vinyl alcohol polymer; a vinyl ether polymer; a vinylpyrrolidone polymer; an acrylic amide polymer; a methacrylamide polymer; and derivatives thereof, etc. Moreover, they may be ionic, including an acrylate polymer, a methacrylate polymer, an alkyl acrylate quaternary ammonium salt polymer, an alkyl methacrylate quaternary ammonium salt polymer, an acrylic amide alkyl quaternary ammonium salt polymer, a styrenesulfonate polymer, etc. Furthermore, they may be cellulose derivatives such as methyl cellulose, ethyl cellulose, hydroxyethyl cellulose, carboxymethyl cellulose; starch derivatives such as methylated starch, ethylated starch, hydroxyethyl starch, carboxymethyl starch; algin acid derivatives such as propyrene glycol alginate; animal-based polymer derivatives such as gelatine, casein, albumin, collagen, etc.; plant-based polymer derivatives such as guar gum, locust bean gum, quince seed gum, carrageenan, etc.; microbial-based polymer derivatives such as xanthan gum, dextran, hyaluronic acid, pullulan, curdlanetc.

A chemical bond of the hydrophobic A block and the hydrophilic B block may be any one of an ether bond, an urethane bond, an amide bond, an ester bond, etc., for example, as long as it is stable.

The carboxylate surfactant which causes the ABA-type amphiphilic polymer to be dissolved or dispersed in the aqueous solvent may be any one as long as it is made up of a hydrophobic alkyl portion and carboxylate. Such one includes a fatty acid salt such as caproic acid sodium, caproic acid potassium, sodium caprylate, capryl potassium, capric acid sodium, capric acid potassium, sodium laurate, potassium laurate, sodium myristate, potassium myristate, sodium palmitate, potassium palmitate, sodium stearate, potassium stearate, etc. In addition to the above-described monocarboxylate, it may be dicarboxylate or tricarboxylate.

As described below, an aqueous ink composition which makes up the recording liquid is to change the viscosity with pH change, which pH change of the recording liquid according to the present mode means supplying protons to the ink composition. As a barometer for the pH at which the carboxyl ions, which is a weak acid salt, changes to protons, there is pKa. The pKa of the fatty acid salt is generally approximately between 7 and 9 in pKa, with the higher one being more preferable.

There is no limit to a weight-average molecular weight for the ABA-type amphiphilic polymer; however, a lower molecular weight is preferable when inkjet ejectability is taken into account when it is completely dissolved or dispersed with carboxylic acid-based surfactant, etc., and a higher molecular weight of polymer is preferable when strength in a state of increased viscosity after impacting is taken into account. Therefore, one with a range between 10,000 and 100,000 is preferable. Moreover, one with a range between 20,000 and 50,000 is more preferable. The number of repetitions of polymer portions is preferably between 100 mer units and 1000 mer units. A polymer concentration within the ink composition is preferably in a range between 0.1 wt. % and 10 wt. % and more preferably between 0.5 wt. % and 5 wt. %.

In order to electrolyze water within the recording liquid, it is necessary to add an electrolyte ingredient for increasing ionic conductivity of the recording liquid. Electrolyte ingredients to be added to the recording liquid include inorganic alkali metal salts such as sodium chloride, potassium chloride, lithium chloride, rubidium chloride, sodium bromide, sodium iodide, sodium sulfate, sodium sulfite, sodium hydrogen sulfite, sodium thiosulfate, potassium sulfate, sodium nitrate, sodium nitrite, potassium nitrate, sodium phosphate, sodium carbonate, sodium hydrogen carbonate, etc.; organic alkali metal salts such as sodium acetate, potassium acetate, sodium oxalate, sodium citrate, sodium hydrogen citrate, potassium citrate, potassium hydrogen citrate, etc.; and organic ammonium salts such as ammonium chloride, ammonium nitrate, ammonium sulfate, tetramethylammonium chloride, tetramethylammonium nitrate, choline chloride, etc.

As a divalent or higher-valent metal salt harms solubility or dispersibility of a coloring agent, an ABA-type amphiphilic polymer, etc., a monovalent metal salt is preferable. In particular, it is preferable to add quaternary ammonium salt as an electrolyte ingredient. Quaternary ammonium ions are charge dispersed by an alkyl group bonded to a central element and are stable because there are few mutual interactions with the coloring agent, the ABA-type amphiphilic polymer, etc. Moreover, the quaternary ammonium ions hardly form clusters with water and thus do not take away hydrated water, which is required for dissolving or dispersing of the coloring agent, the ABA-type amphiphilic polymer, etc. Compounds having a low molecular weight have high conductivity per unit molecular weight (molar ionic conductivity), and tetramethylammonium salt is particularly preferable among the quaternary ammonium salts. Moreover, as counter ions, there are chloride ions, nitrate ions, sulfate ions, etc.; However, at an anode, the chloride ions could cause an electrode reaction to generate chlorine. Therefore, inactive nitrate ions and sulfate ions are preferable.

The viscosity of the recording liquid at the time of ejecting is 1-20 mPa·s, and preferably 2-8 mPa·s. Due to a viscosity increase by a pH change after impacting as described below, the recording liquid undergoes an increase in viscosity of at least 10 times, preferably 100 times, or more preferably 1000 times relative to that at the time of ejecting, so that it turns to a gel state. Preferable ranges of other properties of the recording liquid are 10-60 mN/m, or preferably 20-50 mN/m for surface tension; and 0.01-3 S/m, or preferably 0.02-1 S/m for conductivity.

As shown in FIGS. 2A to 2C, the respective heads 61Y, 61M, 61C, and 61BK include a nozzle plate 61*a*, which is provided on the recording liquid ejecting side which faces downwards as shown; a nozzle 61*b*, which is formed in the nozzle plate 61*a*; an ink chamber 61*c*, into which is supplied the recording liquid from the distributor tank and which the recording liquid fills; and an ink ejecting unit (not shown), which causes the recording liquid within the ink chamber 61*c* to be ejected from the nozzle 61*b*. While a large number of sets of the nozzle plate 61*a*; the nozzle 61*b*; the ink chamber 61*c*; and the ink ejecting unit are provided in the respective heads 61Y, 61M, 61C, and 61BK, only one set thereof is shown.

The nozzle plate 61*a*, a detailed illustration of which is omitted, includes a substrate; and a water repellent film which is formed on a face on the side opposing the intermediate transfer body 37 of the substrate. The water repellent film, which may be formed by applying a fluorine-based water repellency agent or a silicone-based water repellency agent, or which may be formed by plating a fluorine-based polymer, a fluorine-metal compound eutectoid, etc., is not particularly limited thereto as long as it is a film with water repellency.

The nozzle plate 61*a* is set with a gap to the intermediate transfer body 37 of between 50 μm and 200 μm. When the above-mentioned gap is less than 50 μm, it may become difficult to maintain the gap, between the intermediate transfer body 37 as a rotating body and the nozzle plate 61*a*, while, when the above-mentioned gap exceeds 200 μm, it becomes difficult for the below-described liquid-column bridge to be formed. There is no particular problem with less than 50 μm as long as the gap can be maintained and there is no problem with greater than or equal to 200 μm as long as a stable liquid-column bridge is formed.

The ink ejecting unit includes a piezoelectric element as an actuator for turning the recording liquid from the respective nozzles 61*b* into liquid droplets to be ejected and impact onto the transfer sheet S. The ink ejecting unit is arranged to eject the recording liquid from the nozzle 61*b* in response to a voltage pulse which is applied to the piezoelectric element through control by the control unit 40. Here, the control unit 40 functions as an ink ejecting control unit. The control unit 40 functions as the ink ejecting control unit, inputting, into the piezoelectric element, a voltage pulse with a predetermined signal waveform that is for driving the above-described piezoelectric element.

The actuator for the ink ejecting unit may be a movable actuator of a different scheme, which is a shape deforming element scheme, such as a piezoelectric scheme, or may be what causes the recording liquid to be ejected from the nozzle 61*b* with a heating heater scheme such as a thermal scheme, etc.

The energizing unit 33 includes electrodes 65Y, 65M, 65C, 65BK; a power supply 33*a* which can switch between positive and negative polarities; an electric circuit (not shown), which connects the power supply 33*a* to the support 37*a* and the electrodes 65Y, 65M, 65C, and 65BK; and a voltage applying control unit and a potential applying control unit that are realized as a part of functions of the control unit 40 and that control application timing, application time period, switching of polarity of voltage and potential by the power supply 33*a*. The control unit 40 as the voltage applying control unit and the potential applying control unit also functions as a voltage changing unit and a potential changing unit that change the voltage and the potential of the power supply 33*a*.

The power supply 33*a* normally has the positive pole connected to the support 37*a* and the negative pole connected to the electrodes 65Y, 65M, 65C, and 65BK. Thus, the energizing unit 33 normally includes the intermediate transfer body 37 as an anode and the electrodes 65Y, 65M, 65C, and 65BK as a cathode.

As shown in FIG. 1, the cleaning unit 34 is made of a cleaning blade as a cleaning member which is formed with rubber as an elastic body, which is abutted against the intermediate transfer body 37 in a so-called counter abutment mode. The cleaning blade may be abutted against the intermediate transfer body 37 in a trailing abutment mode and not the counter abutment mode. The cleaning unit 34 may include a cleaning roller as a cleaning member in addition to the cleaning blade.

In the image forming apparatus 100 with such a configuration as described above, with an input of a predetermined signal indicating a start of image forming, the intermediate transfer body 37 rotates in the A1 direction while opposing the respective heads 61Y, 61M, 61C, and 61BK, and, in the process, recording liquids of yellow, magenta, cyan, and black are ejected from the upstream side to the downstream side in the A1 direction in a manner such that they are successively overlapped at staggered timings so that image regions of the colors of yellow, magenta, cyan, and black overlap at the same position of the intermediate transfer body 37, temporarily carrying an image on the intermediate transfer body 37.

Then, with the control unit 40 as the voltage applying control unit and the potential applying control unit, the energizing unit 33 is driven and a voltage and a potential are applied between the support 37*a* and the electrodes 65Y, 65M, 65C, and 65BK from the power supply 33*a*.

In this state, the recording liquid is provided onto the intermediate transfer body 37 from the respective heads 61Y, 61M, 61C, and 61BK, at which time, first, from the heads 61Y, 61M, 61C, and 61BK as shown in FIG. 2A, the recording liquid which forms a meniscus in the nozzle 61*b* as shown in FIG. 2B moves towards the intermediate transfer body 37, so that a liquid-column bridge made of the recording liquid is temporarily formed between the nozzle 61*b* and the intermediate transfer body 37. Then, as shown in FIG. 2C, the liquid-column bridge made up of the recording liquid is carried on the intermediate transfer body 37 by its being divided, so that an image is formed on the intermediate transfer body 37 by the recording liquid.

Then, as shown in FIG. 2B, in a state such that the liquid-column bridge made up of the recording liquid is formed, an increase in viscosity of the recording liquid occurs by the energizing unit 33. More specifically, by voltage application and potential application of the energizing unit 33, the below-described respective electrode reactions occur at the electrodes 65Y, 65M, 65C, and 65BK, which are cathodes; and at the intermediate transfer body 37, which is an anode, so that water, which is included in the liquid-column bridge of the recording liquid, is electrolyzed.

$$\text{Cathode: } 4H_2O+4e^- \rightarrow 2H_2+4OH^- \qquad \text{Reaction formula (1)}$$

$$\text{Anode: } 2H_2O \rightarrow 4H^+ + O_2 + 4e^- \qquad \text{Reaction formula (2)}$$

Figure 3:
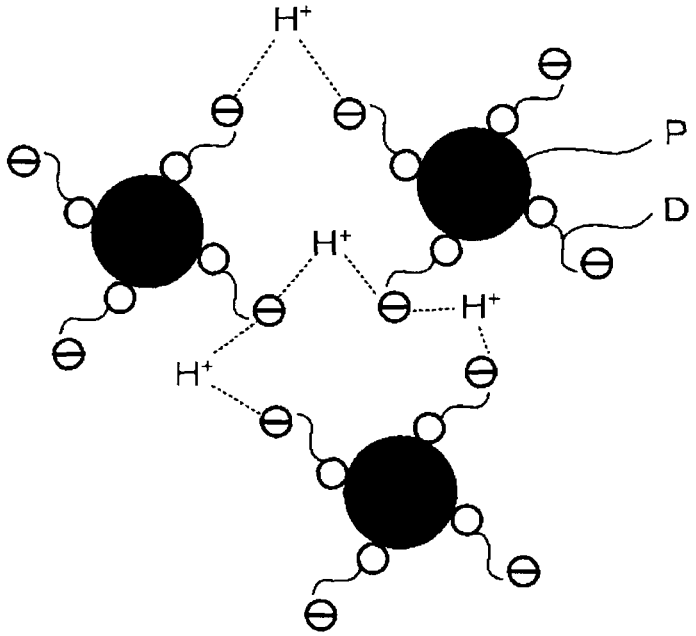
FIG. 3 is a conceptual diagram showing a state in which pigments within the conductive recording liquid ejected from the head in the image forming apparatus shown in FIG. 1 cohere via protons.

In this way, water included in the liquid-column bridge of the recording liquid oxidizes, so that protons (H+) are generated on a surface of the intermediate transfer body 37, which functions as the anode, pigments P which are dispersed with an anionic dispersant D cohere via the protons as shown in FIG. 3. Alternatively, when the recording liquid contains the ABA-type amphiphilic polymer and the carboxylic acid-based surfactant, the carboxylic acid-based surfactant turns into protons, so that hydrophobic groups of the ABA-type amphiphilic polymer bond together, causing an increase in the viscosity of the recording liquid.

With such an action, an occurrence of a blur between adjacent dots is suppressed, so that a high-definition image is formed. A time to form such a bridge as described above can be controlled with a peak voltage, a pulse width, etc., of an electromagnetic pulse applied to the piezoelectric element.

Figure 4:
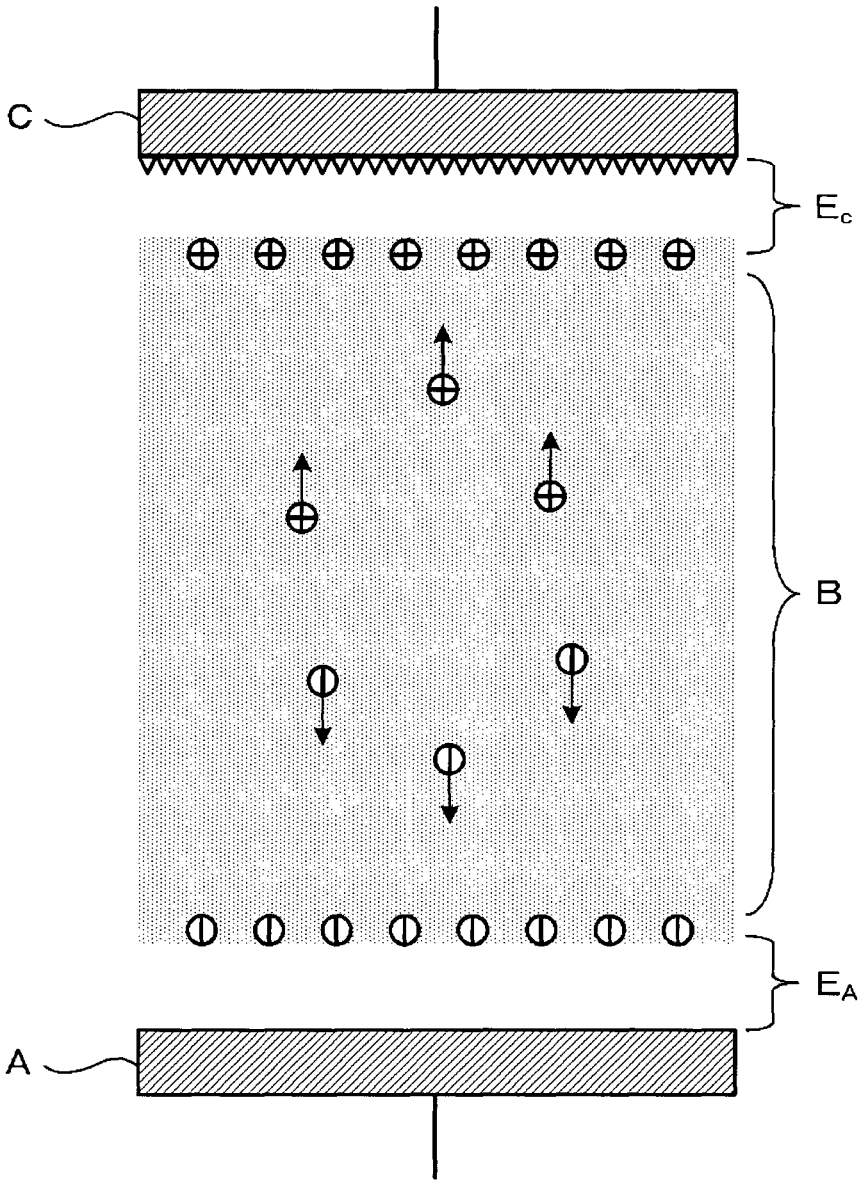
FIG. 4 is a conceptual diagram showing a state of a liquid column with the conductive recording liquid which is formed between a cathode and an anode in the image forming apparatus shown in FIG. 1.

Now, using FIG. 4, a phenomenon which occurs between the cathode and the anode is described. While the liquid-column bridge is being formed, a portion between the cathode and the anode is connected through the recording liquid, and inside a recording liquid B therebetween, cations and anions respectively move to the vicinity of a cathode C and an anode A. As a result, a charging speed of respective electric double layers $E_C$ and $E_A$, which are formed on a surface of the cathode C and the anode A, is generally determined by conductivity of the recording liquid B between the cathode C and the anode A and a concentration of ions contained in the recording liquid.

Here, when a voltage of the electric double layers $E_C$ and $E_A$ reaches a few volts, water is electrolyzed, so that a Faraday current flows. As a result, on a surface of the anode A, water oxidizes to produce protons. In other words, at a moment at which the above-described bridge is formed, protons are efficiently generated on the bridge. Thus, an increase in the viscosity of the recording liquid occurs at the same time the recording liquid impacts onto the intermediate transfer body 37. As a result, a blur of pigments between neighboring recording liquid dots does not occur, so that a very high definition solute image is formed.

Here, it is believed that, when an electrode area of the cathode C is larger than an electrode area of the anode A, a potential difference of the electric double layer $E_A$ becomes high earlier than a potential difference of the electric double layer $E_C$, while, when the potential difference of the electric double layer $E_C$ is not sufficient for electrolysis to occur, even when the potential difference of the electric double layer $E_A$ is sufficiently high, an electrolytic reaction hardly occurs in the $E_A$.

The energizing unit 33 is arranged for conducting voltage and potential applications between the intermediate transfer body 37 and the electrodes 65Y, 65M, 65C, and 65BK for electrolyzing the recording liquid at an electrode interface while the liquid column is forming a bridge. Here, the electrode area of the cathode C represents an area in which the recording liquid is in contact with the surface of the electrodes 65Y, 65M, 65C, and 65BK, while the electrode interface represents an interface between the recording liquid and the surface of the electrodes 65Y, 65M, 65C, and 65BK.

The above-described voltage application is controlled by the control unit 40 which functions as a voltage applying control unit, a potential applying control unit, and a voltage changing unit in order to control discharging caused by a potential or a voltage applied to the recording liquid by the voltage application.

A time between when the liquid-column bridge is formed to when it is divided is normally a few μs to a few tens μs, while conductivity of the recording liquid is normally a few tens mS/m to a few S/m. Thus, in order to form an image onto the intermediate transfer body by the recording liquid, 1.23 V, which is a theoretical electrolyzing voltage of water, or a range between a few volts and a few ten volts, which is a general condition for electrolysis of water, is insufficient for an applied voltage of the energizing unit 33, so that a few tens volts to a few hundreds volts is preferable.

A transfer sheet S which is supplied from the sheet-supplying unit 20 is supplied to the transfer unit 31 in alignment with a timing at which a tip of an image carried on the intermediate transfer body 37 arrives at the transfer unit 31, the image which is carried on the intermediate transfer body 37 is transferred onto the transfer sheet S which passes through the transfer unit 31 while the transfer roller 38 rotates therewith, so that an image is formed onto a surface of the transfer sheet S. The transfer sheet S, on which the image is formed, is guided to the sheet-discharging platform 25 and stacked onto the sheet-discharging platform 25.

In this way, when the image is transferred onto the transfer sheet S, the recording liquid with an increased viscosity is transferred onto the transfer sheet S. Therefore, the image can be formed by the recording liquid with the increased viscosity as described above to form images at high speed, with high image density and high image quality while preventing or suppressing feathering or bleeding even when the transfer sheet S is a plain sheet of paper.

Moreover, in order to form images at high speed, absorbability onto the transfer sheet S is generally high for the recording liquid since it is necessary to make the recording liquid fast drying, in which case the recording liquid penetrates deep into the transfer sheet S, causing a so-called offset, which is unsuitable for double-side image forming. However, such a viscosity increasing effect reduces absorbability of the recording liquid into the transfer sheet S, so that such an offset is prevented or suppressed, which is suitable for double-side image forming. Moreover, absorbability of the recording liquid onto the transfer sheet S is reduced, simplifying handling of the transfer sheet S, such as suppressing or preventing deforming such as cockling, curling, etc., increasing conveyability of the transfer sheet S on which an image is carried, and preventing or suppressing jamming, etc.

While, with transferring in the transfer unit 31, almost no ingredient of the recording liquid remains on the intermediate transfer body 37 which has passed through the transfer unit 31, the intermediate transfer body 37 gets cleaned by the cleaning unit 34, so that an offset of the recording liquid is highly prevented or suppressed, texture pollution due to the offset is prevented or suppressed even when image forming is repeatedly performed, and image degradation and degradation of the intermediate transfer body 37 is suppressed or prevented, making it possible to perform satisfactory image forming over time.

In the image forming apparatus 100 as described above, in order to perform the satisfactory image forming in which a blur is suppressed or prevented with the above-described viscosity increasing effect, it is preferable to suppress or prevent the recording liquid whose pH changed due to $OH^-$ being generated with the reaction formula (1) being ejected from the heads 61Y, 61M, 61C, and 61BK. As a change in pH occurs as a change on the side in which acidity decreases and a pH value increases, or in other words to the alkaline side, when the recording liquid whose pH changed as described above is ejected from the heads 61Y, 61M, 61C, and 61BK, and carried on the intermediate transfer body 37, even though protons are generated due to electrolysis shown in reaction formula (2), an amount of the protons may encounter a shortage in producing a viscosity increasing effect which is sufficient for suppressing or preventing a blur.

Here, in the image forming apparatus 100, the electrodes 65Y, 65M, 65C, and 65BK are provided within the tanks 81Y, 81M, 81C, and 81BK, so that a likelihood is low that the recording liquid whose pH changed due to $OH^-$ produced by the reaction formula (1) is ejected from the heads 61Y, 61M, 61C, and 61BK and carried onto the intermediate transfer body 37.

For example, if the electrodes 65Y, 65M, 65C, and 65BK are provided within the heads 61Y, 61M, 61C, and 61BK or more specifically within the ink chamber 61*c*, or if the nozzle plate 61*a* is arranged to be an electrode in lieu of the electrodes 65Y, 65M, 65C, and 65BK, in general, it is likely for the recording liquid whose pH changed to be ejected when the above-described change in PH occurs as a volume of the recording liquid within the head is small, so that it is likely for the recording liquid to be carried on the intermediate transfer body 37, making it likely to not obtain a sufficient viscosity increasing effect as described above.

However, in the image forming apparatus 100, as the electrodes 65Y, 65M, 65C, and 65BK are provided within the tanks 81Y, 81M, 81C, and 81BK, a location at which $OH^-$ is produced is far from the nozzle 61*b*, and the recording liquid whose pH has changed mixes with a recording liquid whose pH did not change within the tanks 81Y, 81M, 81C, and 81BK, or in the process leading to the heads 61Y, 61M, 61C, and 615K, or within the heads 61Y, 61M, 61C, and 61BK, and disperses. Thus, the recording liquid which is ejected from the heads 61Y, 61M, 61C, and 61BK and which is carried on the intermediate transfer body 37 is arranged to obtain a sufficient viscosity increasing effect, so that satisfactory image forming is performed in which a blur is suppressed or prevented.

For the same reason, even if air bubbles are produced at the electrode interface due to the electrolysis by the reaction formula (1), a likelihood of their reaching the nozzle 61*b* is low and lowering of the ejecting performance of the recording liquid is prevented or suppressed.

In accordance with pH of the recording liquid that is measured by the pH measuring units 66Y, 66M, 66C, and 66BK, the control unit 40 which functions as the voltage applying control unit and the potential applying control unit conducts a reverse bias control in which, at a timing which is different from a timing at which a potential is applied when a liquid column of the recording liquid is forming a bridge, a potential which is reverse to the above-described potential is applied between the intermediate transfer body 37 and the electrodes 65Y, 65M, 65C, and 65BK by the energizing unit 33.

More specifically, the control unit 40 which functions as the voltage applying control unit and the potential applying control unit conducts the reverse bias control when pH of the recording liquid that is measured by the pH measuring units 66Y, 66M, 66C, and 66BK is a value on the alkaline side relative to a predetermined threshold value.

In this way, the intermediate transfer body 37 functions as the cathode to cause a reaction shown in the reaction formula (1) and the electrodes 65Y, 65M, 65C, and 65BK function as the anodes to cause a reaction shown in the reaction formula (2) to produce $H^+$, decreasing the pH of the recording liquid within the tanks 81Y, 81M, 81C, and 81K and changing it back to the acidic side. Thus, it is ensured that the recording liquid which is ejected from the heads 61Y, b61M, 61C, and 61BK and carried on the intermediate transfer body 37 undergoes a viscosity increasing effect.

The control unit 40 which functions as the voltage applying control unit and the potential applying control unit functions as a pH control unit which conducts a reverse bias control which decreases the pH of the recording liquid within the tanks 81Y, 81M, 81C, and 81BK. Moreover, the energizing unit 33 functions as a pH decreasing unit which decreases the pH of the recording liquid within the tanks 81Y, 81M, 81C, and 81BK.

A timing at which the energizing unit 33, which functions as the pH decreasing unit, applies the reverse bias is desirably timing other than a time of image forming. It is desirable from a point of view of effectively utilizing the recording liquid to set this timing to a time of a so-called non-contributing ejection operation, which is performed before image printing in particular. Therefore, such timing is set to at least a timing at which the non-contributing ejection is performed. The non-contributing ejection is an ejection of the recording liquid that is performed for maintenance with an objective of getting rid of clogging of the nozzle 61*b*, etc.

As the electrodes 65Y, 65M, 65C, and 65BK function as either of the cathode and the anode, taking into account that it may affect performance of the recording liquid when they elute into the recording liquid, at least a surface thereof is desirably formed with a material which has an ionization tendency higher than that of hydrogen, for example, a metal such as platinum, gold, etc., or carbon. There is no need to take into account eluting of the electrodes 65Y, 65M, 65C, 65BK, in a configuration in which they function only as the cathode, even when they are formed with metal, so that a type of the metal is not limited.

While, in the present embodiment, the energizing unit 33 is set to function as the pH decreasing unit, in conjunction therewith or alternatively, the pH decreasing unit may include an adding unit as an acid injecting mechanism which adds an acidic substance to the recording liquid within the tank 81Y, 81M, 81C, and 81BK. For any pH decreasing unit, the pH of the recording liquid is maintained and image quality which is stable is maintained over a long term. The acidic substance, which may be solid or liquid, is desirably liquid, taking into account easiness, rapidity, etc., of pH control and, more specifically, is desirably an aqueous solution of hydrochloric acid, sulfuric acid, nitric acid, or phosphoric acid.

Figure 5:
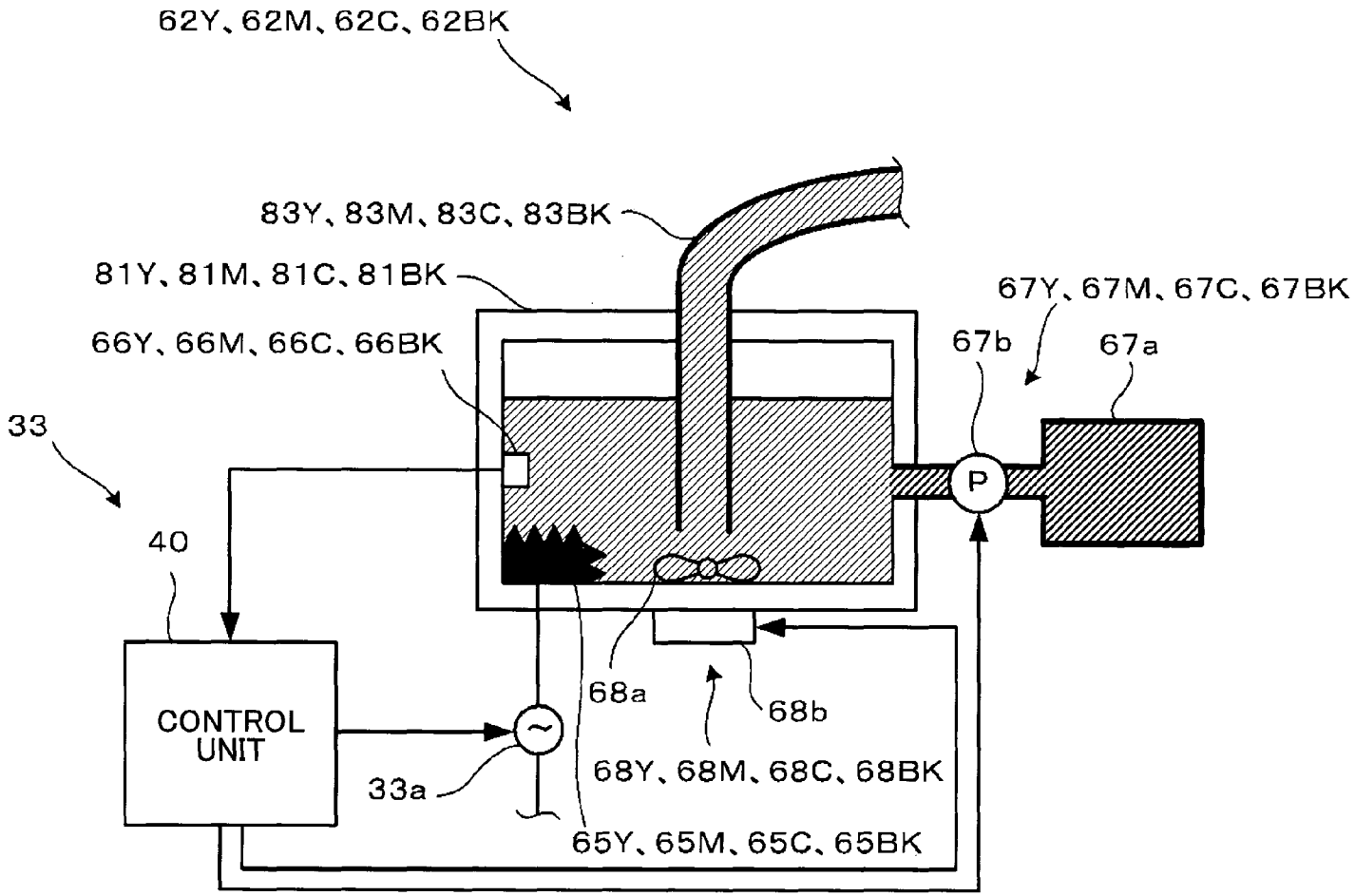
FIG. 5 is an overview diagram showing a different exemplary configuration of the recording liquid supplying unit which can be mounted in the image forming apparatus shown in FIG. 1.

The respective adding units 67Y, 67M, 67C, and 67BK, which are shown in FIG. 5, are integrally formed with the tanks 81Y, 81M, 81C, and 81BK. The adding units 67Y, 67M, 67C, and 67BK include a containing chamber 67*a* which contains sulfuric acid; and a pump 67*b* for supplying sulfuric acid within the containing chamber 67*a* into the tanks 81Y, 81M, 81C, and 81BK.

The pump 67*b* is arranged to have driving thereof controlled by the control unit 40, so that an arbitrary amount of sulfuric acid is added to the containing chamber 67*a*. Driving timing of the pump 67*b* is during or after image forming, or, in other words, when the recording liquid is ejected from the heads 61Y, 61M, 61C, and 61BK, or, when ejecting of the recording liquid from the heads 61Y, 61M, 61C, and 61BK is completed.

As shown, letters 68Y, 68M, 68C, 68BK show agitating units which are integrally formed with the respective tanks 81Y, 81M, 81C, and 81BK and which agitate the recording liquid within the tanks 81Y, 81M, 81C, and 81BK. The agitating units 68Y, 68M, 68C, and 68BK adopt a scheme of a magnetic stirrer which includes a propeller-shaped agitator 68*a* positioned within each of the tanks 81Y, 81M, 81C, and 81BK and a driving unit 68*b* which provides a magnetic field in a periphery of the agitator 68*a* and magnetically rotates and drives the agitator 68*a*.

The agitator 68*a* may be of a different shape such as a stick shape, a plate shape, etc., and not of a propeller shape. The driving unit 68*b* may be what mechanically drives the agitator 68*a* by a motor, etc., and not what magnetically drives the agitator 68*a*. The agitating units 68Y, 68M, 68C, and 68BK may be what agitate the recording liquid within the tanks 81Y, 81M, 81C, and 81BK by moving or vibrating the tanks 81Y, 81M, 81C, and 81BK themselves. The agitating units 68Y, 68M, 68C, and 68BK may be provided in a configuration shown in FIGS. 2A to 2C. The agitating units 68Y, 68M, 68C, and 68BK are not mandatory features.

When the pH of the recording liquid that is measured by the pH measuring units 66Y, 66M, 66C, and 66BK is a value on the alkaline side relative to a predetermined threshold value, the control unit 40 which functions as a pH control unit drives the adding units 67Y, 67M, 67C, and 67BK, or more specifically the pump 67*b* to supply sulfuric acid within the tank 81Y, 81M, 81C, and 81BK, decreasing the pH of the recording liquid within the tanks 81Y, 81M, 81C, and 81BK and changing it back to the acidic side.

Here, when the recording liquid within the tanks 81Y, 81M, 81C, and 81BK stays and is not flowing, the pH of the recording liquid may locally decrease within the tanks 81Y, 81M, 81C, and 81BK and stability of pigments may decrease markedly to cause a decrease in dispersibility of pigments, partial gelation, viscosity increase, etc.

Thus, the control unit 40 which functions as a pH control unit at least drives the agitating units 68Y, 68M, 68C, and 68BK, or more specifically the driving unit 68*b* when the pump 67*b* is driven to decrease the pH of the recording liquid within the tanks 81Y, 81M, 81C, and 81BK to mix, with the recording liquid, the sulfuric acid supplied within the tanks 81Y, 81M, 81C, and 81BK by the adding units 67Y, 67M, 67C, and 67BK and uniformly decreases, in a speedy manner, the pH of the recording liquid within the tanks 81Y, 81M, 81C, and 81BK. In this way, stability of pigments being decreased markedly, causing a decrease in dispersibility of pigments, partial gelation, viscosity increase, etc., is prevented or suppressed.

In the above-described exemplary configuration, the electrodes 65Y, 65M, 65C, and 65BK are provided within the tanks 81Y, 81M, 81C, and 81BK, leading to an advantage that it becomes easy to provide pH measuring units 66Y, 66M, 66C, and 66BK; adding units 67Y, 67M, 67C, and 67BK; and agitating units 68Y, 68M, 68C, and 68BK. However, the electrodes 65Y, 65M, 65C, and 65BK may be provided at any location in contact with the recording liquid in the recording liquid supplying units 62Y, 62M, 62C, and 62BK.

For example, while the same advantage as the above-described advantage is gained when the electrodes 65Y, 65M, 65C, and 65BK are provided in the distributor tank which functions as a fixed tank for the recording liquid, the electrodes 65Y, 65M, 65C, and 65BK can also be provided within the pipes 83Y, 83M, 83C, and 83BK. In this way, the electrodes 65Y, 65M, 65C, and 65BK may be provided on the upstream side relative to the heads 61Y, 61M, 61C, and 61BK of a direction in which the recording liquid flows.

In a flow path of the recoding liquid, as the tanks 81Y, 81M, 81C, and 81BK are at a location most distant from the heads 61Y, 61M, 61C, and 61BK, it is most preferable to provide the electrodes 65Y, 65M, 65C, and 65BK in the tanks 81Y, 81M, 81C, and 81BK from viewpoints of ejection performance of the recording liquid and blur. On the other hand, when the tanks 81Y, 81M, 81C, and 81BK are replaced due to consumption of the recording liquid, etc., it is preferable to provide the electrodes 65Y, 65M, 65C, and 65BK in the distributor tank in order to obtain the above-described advantage inexpensively.

When a change in the pH of the recording liquid within the tanks 81Y, 81M, 81C, and 81BK may be determined by an energizing amount of the energizing unit 33, the pH measuring units 66Y, 66M, 66C, and 66BK may be omitted, in which case the control unit 40 which functions as the voltage applying control unit and the potential applying control unit substantially functions as the pH measuring unit.

Moreover, while the electrodes 65Y, 65M, 65C, and 65BK, which are electrically conducting, are arranged to be of an equal potential as shown in FIG. 1, the electrodes 65Y, 65M, 65C, and 65BK may be arranged to be mutually independent, so that the respective potentials relative to the intermediate transfer body 37 may be arranged to be independently controlled by the control unit 40.

With the following Experiments 1-3 which take into account the above-described conditions, the respective following matters were confirmed.

Experiment 1: Providing the electrodes 65Y, 65M, 65C, and 65BK in the recording liquid supplying units 62Y, 62M, 62C, and 62BK are effective as a measure for a blur of an image.

Experiment 2: The pH measuring units 66Y, 66M, 66C, and 66BK; the adding units 67Y, 67M, 67C, and 67BK; and the agitating units 68Y, 68M, 68C, and 68BK are effective in maintaining the pH of the recording liquid in the recording liquid supplying units 62Y, 62M, 62C, and 62BK.

Experiment 3: The pH measuring units 66Y, 66M, 66C, and 66BK; the agitating units 68Y, 68Y, 68M, 68C, and 68BK; and the energizing unit 33, which functions as the pH decreasing unit are effective in maintaining the pH of the recording liquid in the recording liquid supplying units 62Y, 62M, 62C, and 62BK.

Below the respective experiments are specifically described.

Conditions which are common to the respective experiments are as follows.

The image forming apparatus used in the experiments, which is an image forming apparatus remodeled from Inkjet Printer GX5000 (manufactured by RICOH), has the same configuration as the image forming apparatus 100 and meets the following conditions.

The intermediate transfer body 37, which has, in an outer periphery of an aluminum element tube as the support 37*a*, a silicone rubber layer as the surface layer 37*b* in which carbon is dispersed, that has a volume resistivity of 1.6 Ω·cm and a thickness of 0.5 mm, is rotationally driven in the A1 direction at an outer peripheral line speed of 100 mm/s.

A gap between the intermediate transfer body 37 and the respective heads 61Y, 61M, 61C, and 61BK was set to be 80 μm.

A voltage of 200 V was applied between the intermediate transfer body 37 and the electrodes 65Y, 65M, 65C, and 65BK by the power supply 33*a*.

The transfer roller 38 has a metal core grid on which a rubber layer with a thickness of 5 mm is formed.

As the cleaning unit 34, a blade made of a fluoro rubber was used.

As the electrodes 65Y, 65M, 65C, and 65BK, platinum was used.

In the present experiment, in a longitudinal direction of the intermediate transfer body 37 or in a direction perpendicular to the A1 direction, or in a direction perpendicular to a paper face in FIG. 1 are used the heads 61Y, 61M, 61C, and 61BK in a fixed manner without moving the heads 61Y, 61M, 61C, and 61BK. As shown in FIG. 1, the respective heads 61Y, 61M, 61C, and 61BK were provided at locations which are displaced in the A1 direction.

For brevity, the recording liquid was actually ejected from only the head 61BK; the recording liquid was ejected from all nozzles of the head 61BK at a certain period, or more specifically at 1 kHz.

Prescription of the recording liquid is as follows. The prescription does not contain a pigment ingredient, which is for eliminating an effect on the pH of the recording liquid by the pigment ingredient of the recording liquid provided to the intermediate transfer body 37 cohering based on the reaction formula (2); as a matter of course, the recording liquid used in an actual image forming contains the pigment ingredient.

2-pyrrolidone: 9.0 wt. %

Glycerin: 16.0 wt. %

Tetramethylammonium: 5 wt. %

Propylene glycol monobutyl ether: 1.0 wt. %

Distilled water: residual quantity

It was arranged to maintain a state in which the transfer roller 38 is separated from the intermediate transfer body 37 and, without transferring the recording liquid provided to the intermediate transfer body 37, to have the whole of such a recording liquid directed towards the cleaning unit 34.

Experiment 1

Voltage application by the energizing unit 33 was started while having the recording liquid ejected from the head 61BK, the recording liquid on the intermediate transfer body 34 was scraped by the cleaning unit 34 for each predetermined time period, the pH thereof was measured, and the value thereof was recorded. The voltage application by the energizing unit 33 was completed at a timing of 20 minutes from a start thereof.

As a comparative example, a nozzle plate 61*a* of the heads 61Y, 61M, 61C, and 61K, which was set to be conductive, was used in lieu of the electrodes 65Y, 65M, 65C, and 65BK, and the pH of the recording liquid similarly scraped by the cleaning unit 34 was measured to record the value thereof.

Figure 6A:
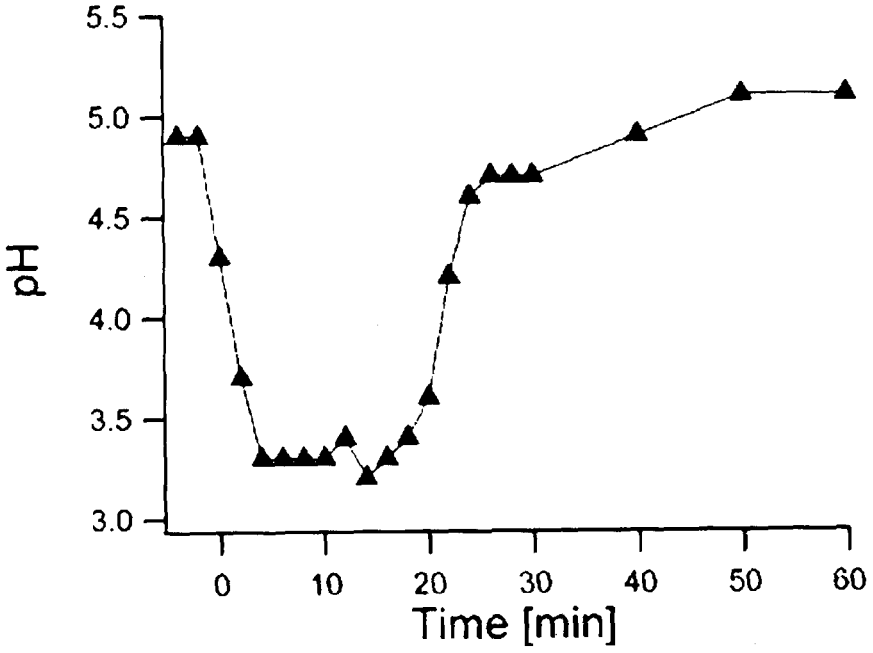
FIGS. 6A and 6B are correlation diagrams showing time progress in pH of a recording liquid on the intermediate transfer body that is obtained as results of an experiment performed for confirming that image forming may be performed which suppresses a blur by applying the present invention.
Figure 6B:
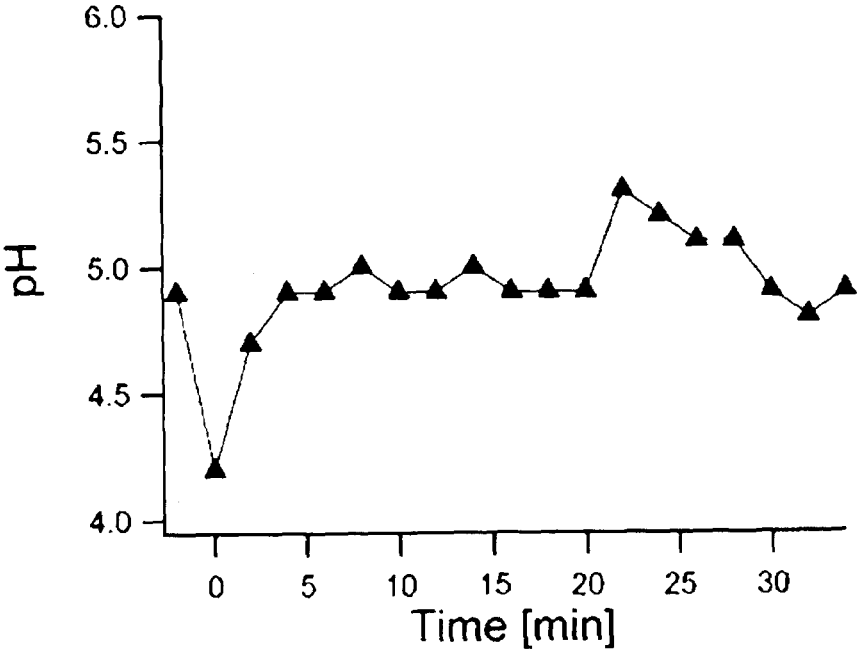

These measured results are shown in FIGS. 6A and 6B. FIG. 6A shows a case in which the electrodes 65Y, 65M, 65C, and 65BK were used, while FIG. 6B shows a case in which a nozzle plate 61*a* was used in lieu of the electrodes 65Y, 65M, 65C, and 65BK. 0 on a horizontal axis means a starting timing of the voltage application by the energizing unit 33. Scales of vertical and horizontal axes differ between FIG. 6A and FIG. 6B.

The following was revealed for the case shown in FIG. 6A.

The pH of the recording liquid collected at the start of the voltage application decreased, so that, at the end of the voltage application, the pH of the recording liquid changed back to a value before the voltage application.

Moreover, the pH of the recording liquid within the tank 81BK, which was measured after completing the voltage application, was 5.1, which was higher than the original pH of 4.9. This is interpreted to be due to an electrolytic reaction occurring in the electrode 65BK within the tank 81BK. As a volume of the tank 81BK is large, a change in the pH is small compared to that for the recording liquid provided onto the intermediate transfer body 37.

The following was revealed for the case shown in FIG. 6B.

In a manner similar to the case shown in FIG. 6A, the pH of the recording liquid collected at the start of the voltage application decreased, but a decreased time interval was shorter compared to that for the case shown in FIG. 6A, and also it soon changed back to the original pH. This is believed to be as a result of a portion of $OH^-$ generated in the nozzle plate 61*a*, which is the cathode, dispersing within the heads 61Y, 61M, 61C, and 61BK and the remainder being contained in the recording liquid ejected.

In other words, it is believed that a small decrease in the pH is seen initially due to an amount of $OH^-$ contained in the ejected recording liquid becoming greater than an amount of $H^+$ produced in the intermediate transfer body 37, after which the both amounts approach the same level to approach the original pH of the recording liquid as a steady state is approached.

What is described in the above is also supported by the fact that the pH of the recording liquid has increased at the end of the voltage application.

By comparing FIG. 6A and FIG. 6B, it is seen that acidity of the recording liquid provided onto the intermediate transfer body 37 increases more for the case shown in FIG. 6A by the voltage application by the energizing unit 33. This means that, on the intermediate transfer body 37, a viscosity increasing effect of the recording liquid more satisfactorily occurs and is more effective as a blur countermeasure for the case shown in FIG. 6A when pigments, or the ABA-type amphiphilic polymers and carboxylic acid based surfactants are contained in the recording liquid.

Experiment 2

In addition to conditions of Experiment 1, the pH measuring units 66Y, 66M, 66C, and 66BK were provided within the tanks 81Y, 81M, 81C, and 81BK, and the adding units 67Y, 67M, 67C, and 67BK; and the agitating units 68Y, 68M, 68C, and 68BK were provided in the tanks 81Y, 81M, 81C, and 81BK. As an acidic substance, sulfuric acid 0.1 Normal was used.

After performing the same evaluation as Experiment 1, the fact that the pH of the recording liquid within the tank 81BK increased was confirmed, after which the adding unit 67BK was driven while measuring the pH to add sulfuric acid little by little. In this way, when sulfuric acid is added little by little while measuring the pH, it is set for the agitating unit 68BK to agitate the recording liquid within the tanks 81Y, 81M, 81C, and 81BK. Thereafter, injecting of sulfuric acid was finished when the pH of the recording liquid within the tank 81BK changed back to the original pH.

In this way, it was confirmed that the pH within the tank 81BK was maintained constant with injecting of an acidic substance.

Experiment 3

In addition to conditions of Experiment 1, the pH measuring units 66Y, 66M, 66C, and 66BK were provided within the tanks 81Y, 81M, 81C, and 81BK, and the agitating units 68Y, 68M, 68C, and 68BK were provided in the tanks 81Y, 81M, 81C, and 81BK, and the energizing unit 33 was set to function as the pH decreasing unit, so that a reverse bias control was conducted.

The energizing unit 33 conducts a reverse bias control which applies a voltage of 200 V as in the Experiment 1 at a time of image forming, but which, at a time of non-image forming, applies 200 V in a direction opposite a direction at the time of image forming. The heads 61Y, 61M, 61C, and 61BK eject a recording liquid not only when a voltage of 200 V is applied by the energizing unit 33 in a manner similar to the Experiment 1, but also when the reverse bias control is conducted. The recording liquid which is provided onto the intermediate transfer body 37 in the reverse bias control was collected with the cleaning unit 34 and discarded.

After performing the same evaluation as in Experiment 1, a reverse bias control was performed while agitating the recording liquid within the tanks 81Y, 81M, 81C, and 81BK with the agitating unit 68BK and the pH of the recording liquid within the tank 81BK was measured by the pH measuring unit 66BK during the control. Here, a control was performed, by the control unit 40, of driving the head 61BK to continue ejecting the recording liquid until the pH of the recording liquid within the tank 81BK decreased and changed back to the initial value thereof.

Then, it was confirmed, by the pH measuring unit 66BK that the pH of the recording liquid within the tank 81BK was increasing in a state after the same evaluation as in Experiment 1 was performed and it was confirmed that, upon conducting a reverse bias control and performing ejecting of the recording liquid while measuring the pH, the pH within the recording liquid within the tank 81BK changed back to the original pH, at which time ejecting of the recording liquid from the head 61BK was completed.

In this way, it was confirmed that the pH within the tank 81BK was maintained constant with the reverse bias control.

Example

An image evaluation was performed by the image forming apparatus, taking into account the above-described experimental results.

The image evaluation was performed for Example using the same apparatus as Experiment 2, such as applying a potential using the electrodes 65Y, 65M, 65C, and 65BK and for Comparative Examples which are different as described below in potential application conditions relative to Example.

Points which differ from Experiment 2 in common between Example and Comparative Examples are that recording liquids of four colors that contain therein coloring agents are used as recording liquids and that an image formed on the intermediate transfer body 37 is transferred onto plain paper, which is the transfer sheet S.

As recording liquids of the colors, the following prescriptions were used.

Black Recording Liquid

Sulfonic acid group bonded type carbon black pigment dispersing liquid (CAB-O-JET-200, solid 20 wt. %, manufactured by Cabot): 35.0 wt. %

2-pyrrolidone: 10.0 wt. %

Glycerin: 14.0 wt. %

Propylene glycol monobutyl ether: 0.9 wt. %

Hydrophobic modified polyether urethane (corresponding to an ABA-type amphiphilic polymer: manufactured by ADEKA): 0.75 wt. %

Potassium laurate (corresponding to carboxyl acid-based surfactant): 0.5 wt. %

Dehydroacetic acid soda: 0.1 wt. %

Distilled water: residual quantity

Thereafter, an adjustment is made to pH 9.1 with a 5 wt. % aqueous solution of lithium hydroxide, which is pressure filtered with a membrane filter of an average pore diameter of 0.8 μm.

Yellow Recording Liquid

Sulfonic acid group bonded type yellow pigment dispersing liquid (CAB-O-JET-270Y, solid 10 wt. %, manufactured by Cabot); 40.0 wt. %

Triethylene glycol: 15.0 wt. %

Glycerin: 25.0 wt. %

Propylene glycol monobutyl ether: 0.9 wt. %

Hydrophobic modified polyether urethane (corresponding to an ABA-type amphiphilic polymer: manufactured by ADEKA): 0.75 wt. %

Potassium laurate (corresponding to carboxyl acid-based surfactant): 0.5 wt. %

Dehydroacetic acid soda: 0.1 wt. %

Distilled water: residual quantity

Thereafter, an adjustment is made to pH 9.1 with a 5 wt. % aqueous solution of lithium hydroxide, which is pressure filtered with a membrane filter of an average pore diameter of 0.8 μm.

Magenta Recording Liquid

Sulfonic acid group bonded type magenta pigment dispersing liquid (CAB-O-JET-260M, solid 10 wt. %, manufactured by Cabot); 40.0 wt. %

Diethylene glycol: 20 wt. %

Propylene glycol monobutyl ether: 0.9 wt. %

Hydrophobic modified polyether urethane (corresponding to an ABA-type amphiphilic polymer: manufactured by ADEKA): 0.75 wt. %

Potassium laurate (corresponding to carboxyl acid-based surfactant): 0.5 wt. %

Dehydroacetic acid soda: 0.1 wt. %

Distilled water: residual quantity

Thereafter, an adjustment is made to pH 9.1 with a 5 wt. % aqueous solution of lithium hydroxide, which is pressure filtered with a membrane filter of an average pore diameter of 0.8 μm.

Cyan Recording Liquid

Sulfonic acid group bonded type cyan pigment dispersing liquid (CAB-O-JET-250C, solid 10 wt. %, manufactured by Cabot); 40.0 wt. %

Ethylene glycol: 4.0 wt. %

Triethylene glycol: 14.0 wt. %

Propylene glycol monobutyl ether: 0.9 wt. %

Hydrophobic modified polyether urethane (corresponding to an ABA-type amphiphilic polymer: manufactured by ADEKA): 0.75 wt. %

Potassium laurate (corresponding to carboxyl acid-based surfactant): 0.5 wt. %

Dehydroacetic acid soda: 0.1 wt. %

Distilled water: residual quantity

Thereafter, an adjustment is made to pH 9.1 with a 5 wt. % aqueous solution of lithium hydroxide, which is pressure filtered with a membrane filter of an average pore diameter of 0.8 μm.

Using Ricoh Business Coat Gloss as a recording medium for transfer, which is a transfer sheet S to be conveyed between the intermediate transfer body 37 and the transfer roller 38, a conductive recording liquid image which was formed on the intermediate transfer body 37 was transferred, and the image was evaluated.

As Comparative Example 1, an image was evaluated for a case in which the nozzle plates 61*a* of the heads 61Y, 61M, 61C, and 61BK were set to be conductive and were used in lieu of the electrodes 65Y, 65M, 65C, and 65BK (the same as the comparative example in Experiment Moreover, as Comparative Example 2, an image was formed and evaluated with an application voltage by the energizing unit 33 in Example as 0 V.

For image evaluation, three items of bleeding, featuring, and density irregularity were evaluated and results of the evaluation were ranked in three levels of Good, Medium, and Poor.

Results of the evaluation are shown in the following Table.

TABLE 1

| | BLEEDING | FEATHERING | DENSITY IRREGULARITY |
|---|---|---|---|
| EXAMPLE | GOOD | GOOD | GOOD |
| COMPARATIVE EXAMPLE 1 | MEDIUM | MEDIUM | POOR |

TABLE 1-continued

| | BLEEDING | FEATHERING | DENSITY IRREGULARITY |
|---|---|---|---|
| COMPARATIVE EXAMPLE 2 | POOR | POOR | GOOD |

From the Table, in Example, compared to Comparative Example 2, an effect of suppressing bleeding and feathering is seen conspicuously. In Comparative Example 1, the effect of suppressing the bleeding and the feathering is weakened by the $OH^-$, which is produced within the heads 61Y, 61M, 61C, and 61BK. Moreover, in Comparative Example 1, it is believed that turning into non-ejection or a change in an ejecting state of the nozzle 61*b* occurred due to hydrogen gas generated within the heads 61Y, 61M, 61C, and 61BK, leading to an occurrence of the density irregularity.

While preferred embodiments of the present invention are described in the above, the present invention is not limited to such specific embodiments, so that various modifications and changes are possible within the spirit of the present invention that is recited in the claims unless specifically limited in the above explanations.

For example, pigments within a conductive recording liquid may be dispersed with a cationic dispersant and cohered via hydroxide ions which are generated on a surface of the intermediate transfer body which functions as a cathode.

There is no need for the whole of the intermediate transfer body to be conductive, so it suffices that at least a surface thereof be conductive.

The image forming apparatus to which the present invention is applied is not limited to the above-described types of image forming apparatuses, so that it may be a different type of image forming apparatus; in other words, it may be a shuttle type with respect to the head, or it may be a copying machine or facsimile unit, or multi-functional machines having these functions; a copying machine such as a monochrome machine related thereto; an image forming apparatus for use in forming an electric circuit; or an image forming apparatus for use in forming a predetermined image in the field of biotechnologies. The number of heads may be increased/decreased according to the use of the image forming apparatus, so that it may be one or a greater number.

Advantages described in the embodiments of the present invention merely list most preferred advantages which are yielded from the present invention, so that the advantages by the present invention are not to be limited to what are described in the embodiments of the present invention.

The present application is based on and claims the benefit of priority of Japanese Patent Application No. 2011-254012 filed on Nov. 21, 2011 and Japanese Patent Application No. 2012-139125 filed on Jun. 20, 2012.

DESCRIPTION OF THE REFERENCE NUMERALS

33 Potential applying unit, pH decreasing unit
37 Intermediate transfer body
40 pH control unit
61*b* Nozzle
61Y, 61M, 61C, 61BK Heads
62Y, 62M, 62C, 62BK Recording liquid supplying units
64 Transfer unit
65Y, 65M, 65C, 65BK Electrodes
66Y, 66M, 66C, 66BK pH measuring units
67Y, 67M, 67C, 67BK pH decreasing units, Adding units

68Y, 68M, 68C, 68BK Agitating units
81Y, 81M, 81C, 81BK Tanks
S Recording material

PRIOR ART DOCUMENTS

Patent Documents

Patent document 1: JP2010-188665A
Patent document 2: JP2010-264717A
Patent document 3: JP2011-62890A

The invention claimed is:

1. An image forming apparatus, comprising:

a head which is provided with a nozzle which ejects a conductive recording liquid containing water and a high molecular anionic dispersant;

an intermediate transfer body to which the conductive recording liquid ejected by the head is provided, at least a surface of which intermediate transfer body is conductive;

a potential applier that applies a potential which can electrolyze the water within the conductive recording liquid which is ejected from the head and which temporarily bridges between the head and the intermediate transfer body;

a transfer roller which transfers, to a recording material, an image carried on the intermediate transfer body with the conductive recording liquid; and a recording liquid supplier that supplies the conductive recording liquid to the head, wherein the potential applier includes an electrode provided at a portion which is in contact with the recording liquid in the recording liquid supplier and applies the potential between the surface of the intermediate transfer body and the electrode, and wherein the water in the conductive recording liquid which bridges therebetween is made to undergo electrolysis to cause hydrogen ions to be generated and the high molecular anionic dispersants to cohere.

2. The image forming apparatus as claimed in claim 1, wherein the recording liquid supplier has a tank which contains the conductive recording liquid for supplying to the head; and the electrode is provided at a portion which is in contact with the recording liquid within the tank.

3. The image forming apparatus as claimed in claim 2, further comprising a pH decreaser that decreases a pH of the conductive recording liquid within the tank.

4. The image forming apparatus as claimed in claim 3, wherein the pH decreaser is an injecting mechanism which adds an acidic substance to the conductive recording liquid within the tank.

5. The image forming apparatus as claimed in claim 3, wherein the pH decreaser is the potential applier that applies a potential of a polarity which is opposite the potential at a timing which is different from a timing for applying the potential.

6. The image forming apparatus as claimed in claim 5, wherein the potential applier, which is the pH decreaser, applies the potential of the polarity which is opposite the potential at a timing at which at least a non-contributing ejection is performed.

7. The image forming apparatus as claimed in claim 3, further comprising:

a pH measurer that measures the pH of the conductive recording liquid within the tank; and a pH controller that drives the pH decreaser in accordance with the pH measured by the pH measurer to decrease the pH of the conductive recording liquid within the tank.

8. The image forming apparatus as claimed in claim 3, further comprising an agitator which agitates the conductive recording liquid within the tank.

9. The image forming apparatus as claimed in claim 1, wherein at least a surface of the electrode is formed of a material which has a higher ionization tendency than that of hydrogen, or that of carbon.

10. The image forming apparatus as claimed claim 1, wherein pigments are dispersed with an anionic dispersant in the conductive recording liquid; and wherein the intermediate transfer body functions as an anode when the potential is applied by the potential applier.

11. The image forming apparatus as claimed in claim 1, wherein the potential applier applies the potential when the recording liquid temporarily bridges between the head and the intermediate transfer body so as to electrolyze the water within the conductive recording liquid.

* * * * *